US010767365B1

(12) United States Patent
Noxon, IV

(10) Patent No.: US 10,767,365 B1
(45) Date of Patent: Sep. 8, 2020

(54) ACOUSTIC ABSORBER FOR BASS FREQUENCIES

(71) Applicant: Arthur Mandarich Noxon, IV, Eugene, OR (US)

(72) Inventor: Arthur Mandarich Noxon, IV, Eugene, OR (US)

( * ) Notice: Subject to any disclaimer, the term of this patent is extended or adjusted under 35 U.S.C. 154(b) by 407 days.

(21) Appl. No.: 15/658,418

(22) Filed: Jul. 25, 2017

Related U.S. Application Data

(60) Provisional application No. 62/375,840, filed on Aug. 16, 2016.

(51) Int. Cl.

| | |
|---|---|
| ***E04B 1/99*** | (2006.01) |
| ***G10K 11/04*** | (2006.01) |
| ***E04B 1/82*** | (2006.01) |
| ***G10K 11/162*** | (2006.01) |

(52) U.S. Cl.
CPC ..... *E04B 1/99* (2013.01); *E04B 1/8209* (2013.01); *E04B 1/994* (2013.01); *G10K 11/04* (2013.01); *G10K 11/162* (2013.01)

(58) Field of Classification Search
CPC . E04B 1/82; E04B 1/8209; E04B 1/99; E04B 1/994; G10K 11/04
USPC ..... 181/30, 195
See application file for complete search history.

(56) References Cited

U.S. PATENT DOCUMENTS 2,160,638 A * 5/1939 Bedell ..... E04B 9/34 181/30
2,488,555 A * 11/1949 Pare ..... E04B 1/8209 181/295
2,502,020 A * 3/1950 Olson ..... G10K 11/16 181/295
2,659,807 A * 11/1953 Wakefield ..... E04B 9/34 362/150
2,715,449 A * 8/1955 Smith ..... F21V 33/00 181/30
3,047,285 A 7/1962 Gross
4,319,661 A * 3/1982 Proudfoot ..... G10K 11/172 181/286
4,548,292 A 10/1985 Noxon
5,035,298 A 7/1991 Noxon
(Continued)

FOREIGN PATENT DOCUMENTS

JP 08170381 A * 7/1996

*Primary Examiner* — Jeremy A Luks
(74) *Attorney, Agent, or Firm* — David S. Alavi

(57) ABSTRACT

An acoustic absorber includes a chamber formed from walls with a resistive portion providing the only communication between the chamber volume and ambient air. In some examples chamber walls enable selection or adjustment of chamber volume or resistive area, thereby altering the acoustic absorption spectrum below 250 Hz. In some examples the chamber volume contains fibrous filler material exhibiting no airflow resistance or acoustic absorption. Density and heat capacity of the fibrous filler material results in the chamber volume exhibiting compressibility of air within the chamber, for at least acoustic frequencies up to about 50 Hz, that is larger than adiabatic compressibility of air. That larger compressibility results in an increased acoustic absorption coefficient, for at least acoustic frequencies up to about 50 Hz, 50% to 100% larger than that of an identical chamber entirely characterized by the adiabatic compressibility of air.

20 Claims, 15 Drawing Sheets

(56) References Cited

U.S. PATENT DOCUMENTS

| | | | | |
|---|---|---|---|---|
| 5,137,111 | A * | 8/1992 | Diduck | E04B 1/8209 181/286 |
| 5,210,383 | A | 5/1993 | Noxon | |
| 5,444,198 | A * | 8/1995 | Gallas | E04B 1/8209 181/295 |
| 5,623,130 | A | 4/1997 | Noxon | |
| 6,851,665 | B2 | 2/2005 | McLaughlin | |
| 7,178,630 | B1 * | 2/2007 | Perdue | E04B 1/8209 181/290 |
| 8,157,052 | B2 * | 4/2012 | Fujimori | G10K 11/175 181/293 |
| 9,683,366 | B2 * | 6/2017 | Gen | G10K 11/168 |
| 2009/0277715 | A1 * | 11/2009 | Scharer | A47B 47/00 181/286 |

* cited by examiner

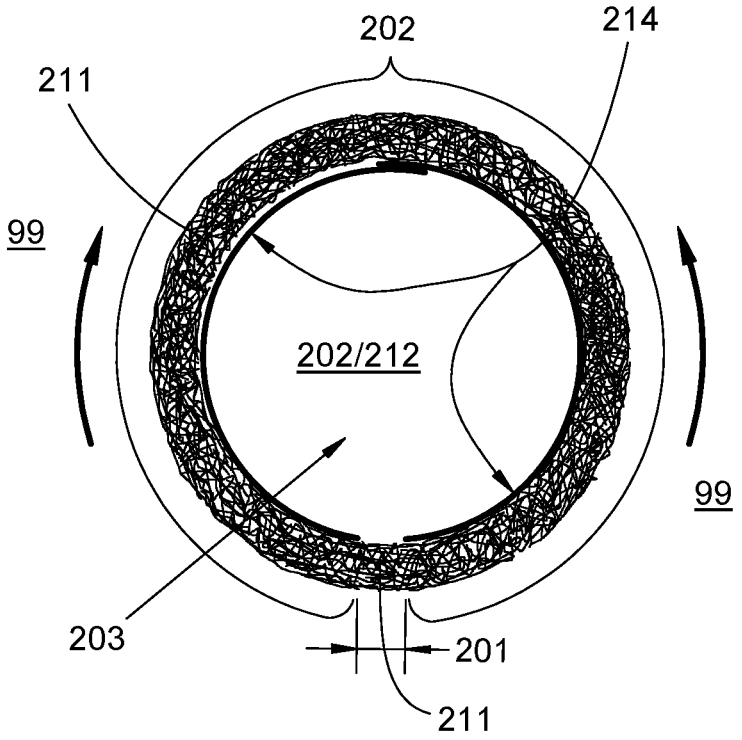
FIG. 4B
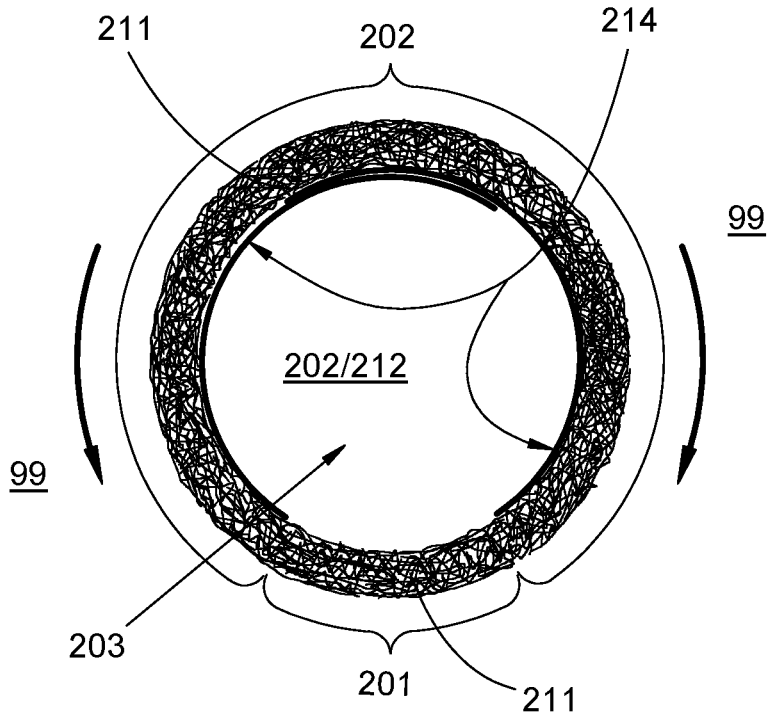

ACOUSTIC ABSORBER FOR BASS FREQUENCIES

BENEFIT CLAIMS TO RELATED APPLICATIONS

This application claims benefit of U.S. provisional App. No. 62/375,840 filed Aug. 16, 2016 in the name of Arthur Mandarich Noxon IV, said provisional application being hereby incorporated by reference as if fully set forth herein.

FIELD OF THE INVENTION

The field of the present invention relates to acoustic absorbers (also referred to as acoustic traps). In particular, apparatus and methods are disclosed herein for providing acoustic absorption at bass acoustic frequencies.

BACKGROUND

Some examples of acoustic absorbers or isothermal heat sinks are disclosed in:

- U.S. Pat. No. 3,047,285 entitled "Semi-isothermal pneumatic support" issued Jul. 31, 1962 to Gross;
- U.S. Pat. No. 4,548,292 entitled "Reflective acoustical damping device for rooms" issued Oct. 22, 1985 to Noxon;
- U.S. Pat. No. 5,035,298 entitled "Wall attached sound absorptive structure" issued Jul. 30, 1991 to Noxon;
- U.S. Pat. No. 5,210,383 entitled "Sound absorbent device for a room" issued May 11, 1993 to Noxon;
- U.S. Pat. No. 5,623,130 entitled "System for enhancing room acoustics" issued Apr. 22, 1997 to Noxon; and
- U.S. Pat. No. 6,851,665 entitled "Air spring heat sink" issued Feb. 8, 2005 to McLaughlin.

SUMMARY

An apparatus for absorbing acoustic energy includes one or more chamber walls that form an enclosed chamber. A portion of the chamber walls resistive to airflow provides the only communication between the chamber volume and ambient air. The one or more chamber walls are arranged so as to enable selection or adjustment of one or both of the chamber volume or the area of the resistive portion, thereby altering the acoustic spectrum of the absorber at least for frequencies less than about 250 Hz.

Another apparatus for absorbing acoustic energy includes one or more chamber walls that form an enclosed chamber. A portion of the chamber walls resistive to airflow provides the only communication between the chamber volume and ambient air. At least a portion of the chamber volume is occupied by fibrous filler material that exhibits only negligible resistance to airflow or acoustic absorption. Density and heat capacity of the fibrous filler material results in the occupied fraction of the chamber volume exhibiting compressibility of air within the chamber, for at least acoustic frequencies up to about 50 Hz, that is larger than adiabatic compressibility of air. The larger compressibility exhibited by the occupied fraction of the chamber volume results in an acoustic absorption coefficient of the apparatus that exceeds by at least 50%, for at least acoustic frequencies up to about 50 Hz, an acoustic absorption coefficient of an identical chamber having an entire interior volume thereof characterized by the adiabatic compressibility of air.

Objects and advantages pertaining to acoustic absorbers may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIG. 4B is a schematic transverse cross-sectional view of another example inventive acoustic absorber that includes a rotating rigid shell for adjusting the resistive wall area.

The embodiments depicted are shown only schematically: all features may not be shown in full detail or in proper proportion, certain features or structures may be exaggerated relative to others for clarity, and the drawings should not be regarded as being to scale. In particular, pictorial representations of various fibrous wall or filler materials should not be interpreted as reflecting their absolute or relative densities. The embodiments shown are only examples: they should not be construed as limiting the scope of the present disclosure or appended claims.

DETAILED DESCRIPTION OF EMBODIMENTS

Figure 1A:
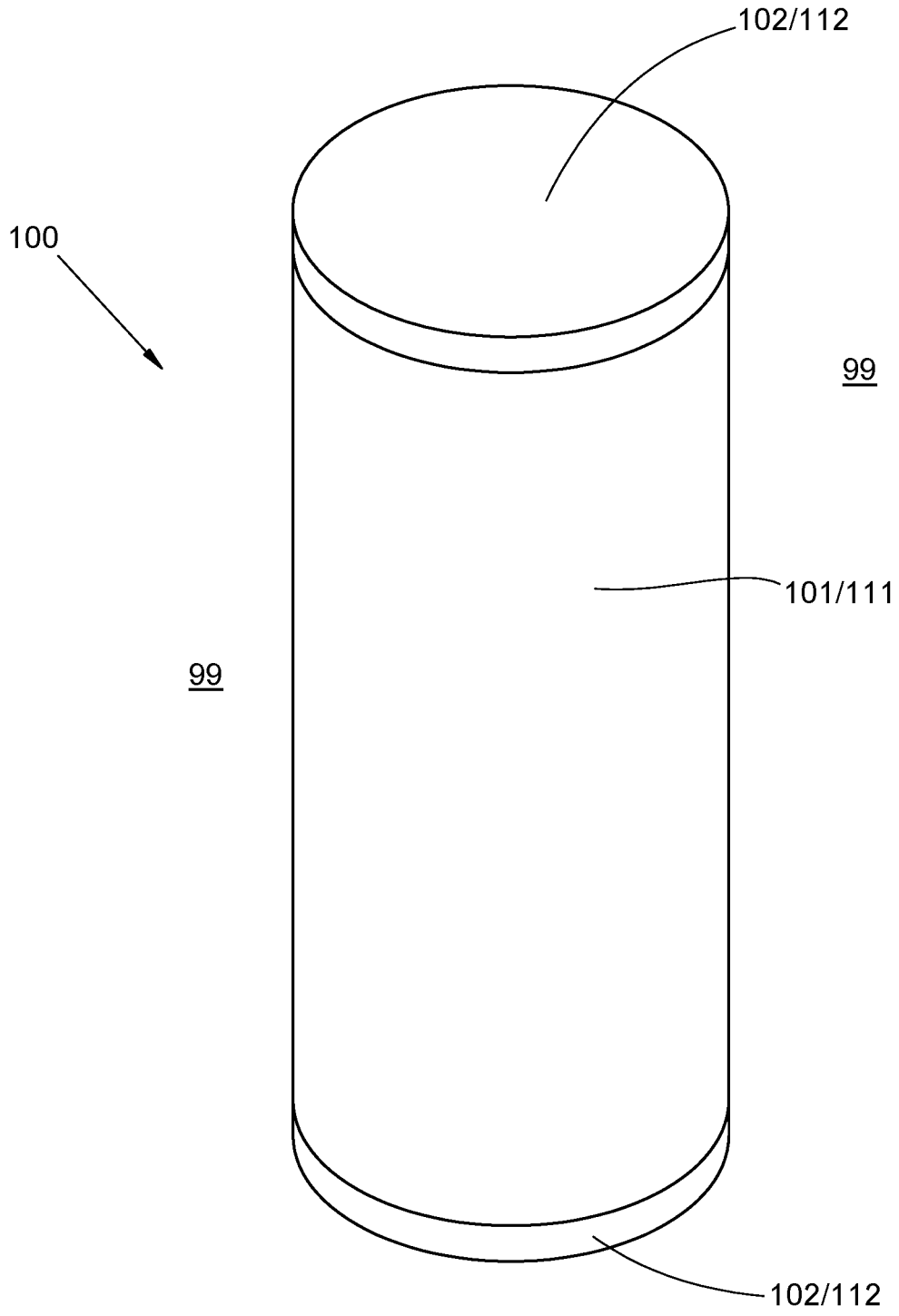
FIGS. 1A, 1B, and 1C are schematic perspective, longitudinal cross-sectional, and transverse cross-sectional views, respectively, of a conventional acoustic absorber including an air-filled but otherwise empty chamber volume and chamber walls including a lateral resistive wall.
Figure 1B:
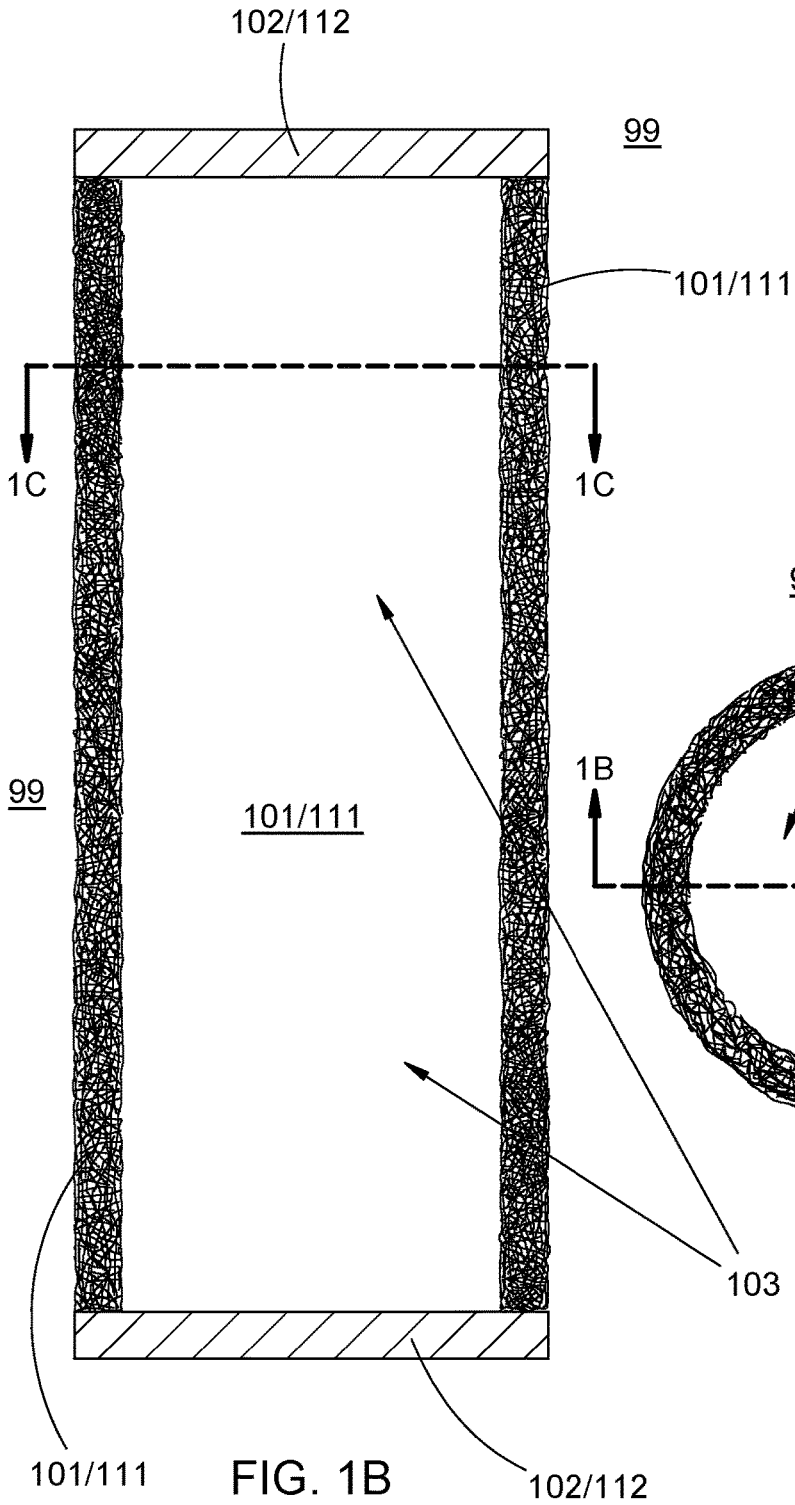
Figure 1C:
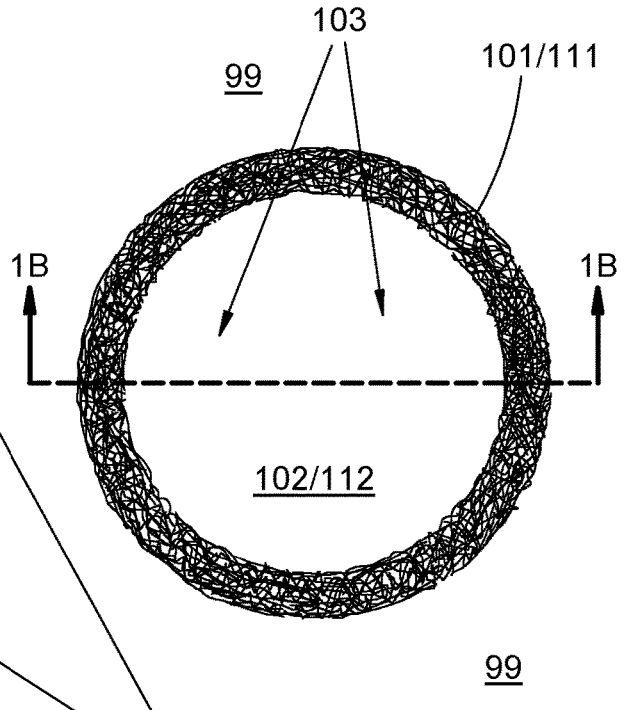

A conventional acoustic absorber 100 is illustrated schematically in FIGS. 1A through 1C. Typically such absorbers are generally cylindrical and are often referred to as "tube traps." That term may be employed herein to denote both conventional and inventive acoustic absorbers, including those that might not necessarily be cylindrical. A conventional acoustic absorber 100 includes one or more chamber walls that form an air-filled, but otherwise empty, enclosed chamber volume 103. The area of the chamber walls include at least a first, non-zero fraction 101 of the wall area that permits resistive airflow therethrough; the chamber volume 103 communicates with ambient air 99 only through the resistive fraction 101 of the wall area. The chamber walls can also include a second fraction 102 that substantially obstructs airflow. The obstructive fraction 102 can be, but need not be, strictly airtight; in some examples the obstructive fraction 102 can include plastic or metal; in some examples the obstructive fraction 102 can include heavy cardboard or wood). In some instances the entirety of the wall area permits resistive airflow. A common arrangement of an acoustic absorber 100 arranged as a conventional tube trap includes a side surface of the cylinder formed from (i) relatively dense fibrous material 111 (e.g., fiberglass having a density of about 5 lb/ft$^3$) that permits resistive airflow, and (ii) circular wooden end caps 112 that obstructs airflow. The tube trap can also include structural features (e.g., a stiff wire mesh (not shown) for mechanical strength or stiffness) or decorative features (e.g., a fabric cover (not shown), perhaps chosen in accordance with other room décor) that do not affect acoustic behavior and are not considered further. In this example the fiberglass side wall 111 forms the resistive fraction 101 of the wall area, while the end caps 112 form the obstructive fraction 102 of the wall area, and together those two fractions 101 and 102 entirely enclose the empty chamber volume 103. For purposes of the present disclosure or appended claims, "empty" shall denote a volume that is air-filled but otherwise empty.

As is well understood, the conventional tube trap acts as an acoustic RC circuit. The area, thickness, and density of the fiberglass resistive wall fraction 101 determine the effective acoustic resistance R; the chamber volume 103 and the adiabatic compressibility of air determine the effective acoustic capacitance C for an empty chamber volume 103. The acoustic absorber 100 exhibits an acoustic cut-off frequency $f_{CO}$ about equal to $\frac{1}{2}\pi RC$, below which acoustic power absorption P decreases with a roll-off of about 6 dB/octave, and above which acoustic power absorption P increases asymptotically toward a maximum absorption level $P_{MAX}$ (which varies as 1/R). The tube trap absorbs at about 50% of that maximum level near the cut-off frequency. In principle the cut-off frequency can be calculated from the area of the resistive wall portion, the specific acoustic impedance of the wall material, the volume of the chamber, and the adiabatic compressibility of air; practically, it is often more straightforward or accurate to measure the cut-off frequency and asymptotic absorption for a given tube trap, and relate corresponding changes in those quantities to fractional changes of volume or resistive area arising from modifications or adjustments of the trap (discussed further below).

Figure 6:
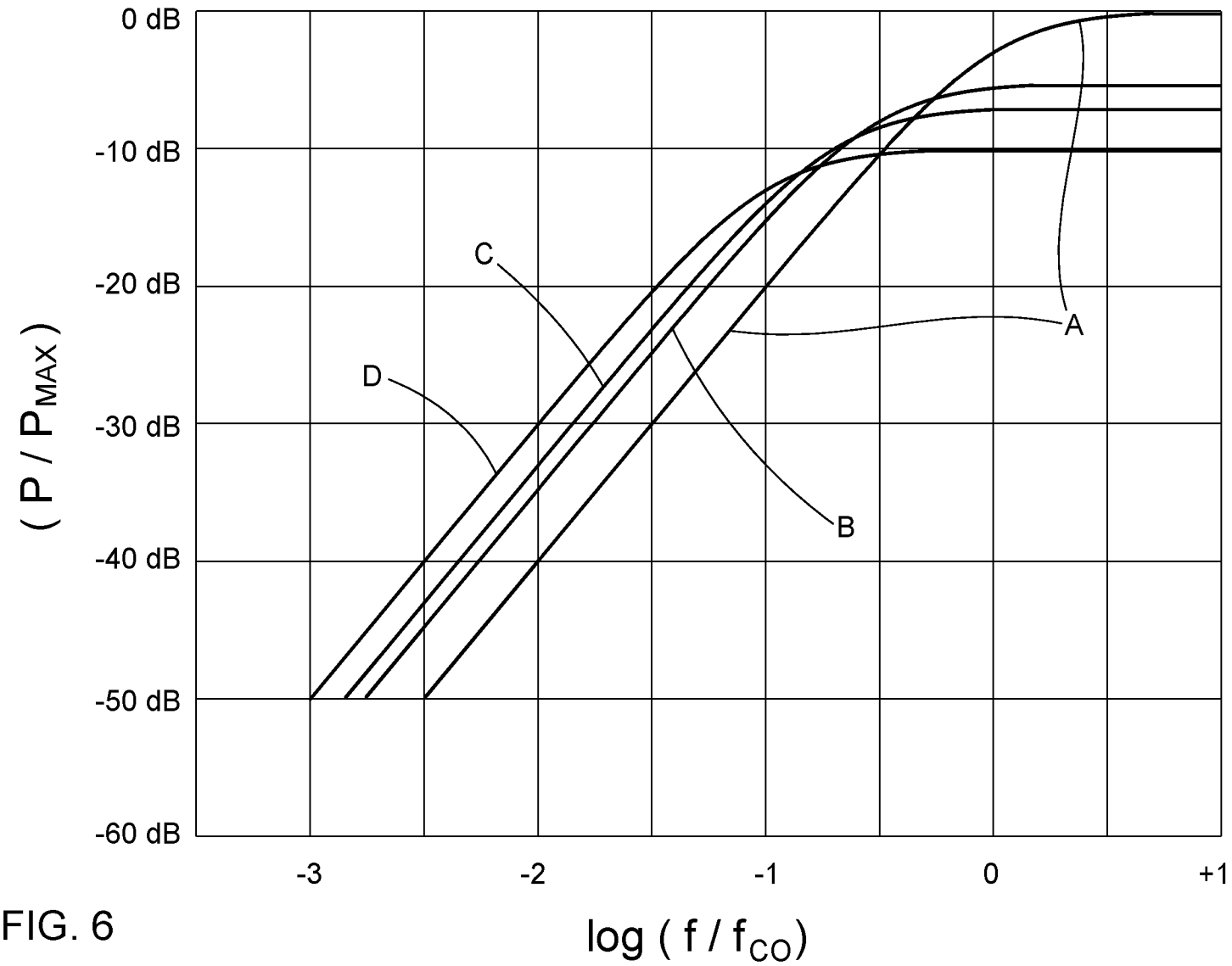
FIG. 6 illustrates schematically examples of acoustic absorption spectra exhibited by a conventional acoustic absorber and several example inventive acoustic absorbers.

A typical acoustic power absorption spectrum is illustrated by curve A of FIG. 6. A typical example comprises a cylinder about 16 inches in diameter and about 4 feet long, with fiberglass side walls 111 that are about 1 to 2 inches thick (typically about 1.5 inches thick). The impedance of the resistive wall fraction 101 can be selected to be at least roughly impedance-matched with air (e.g., about 400-430 rayls at air temperatures between about 0° C. and about 35° C.). With those dimensions the acoustic absorber 100 is observed to exhibit an acoustic cut-off frequency $f_{CO}$ of about 55 Hz. The frequency-dependent acoustic absorption behavior shifts or scales accordingly with differing chamber volume or differing resistive wall impedance or area (e.g., cut-off frequencies ranging from about 40 Hz to about 110 Hz for tube diameters ranging from about 20 inches to about 9 inches, respectively). Any suitable volume, wall density, or wall thickness can be employed as needed or desired in conventional or inventive examples. In some conventional and inventive examples the resistive fibrous wall material 111 comprises glass fibers at a density between about 2 lb/ft$^3$ and about 10 lb/ft$^3$; in some of those examples the resistive fibrous wall material more typically comprises glass fibers at a density between about 4 lb/ft$^3$ and about 6 lb/ft$^3$.

Figure 2A:
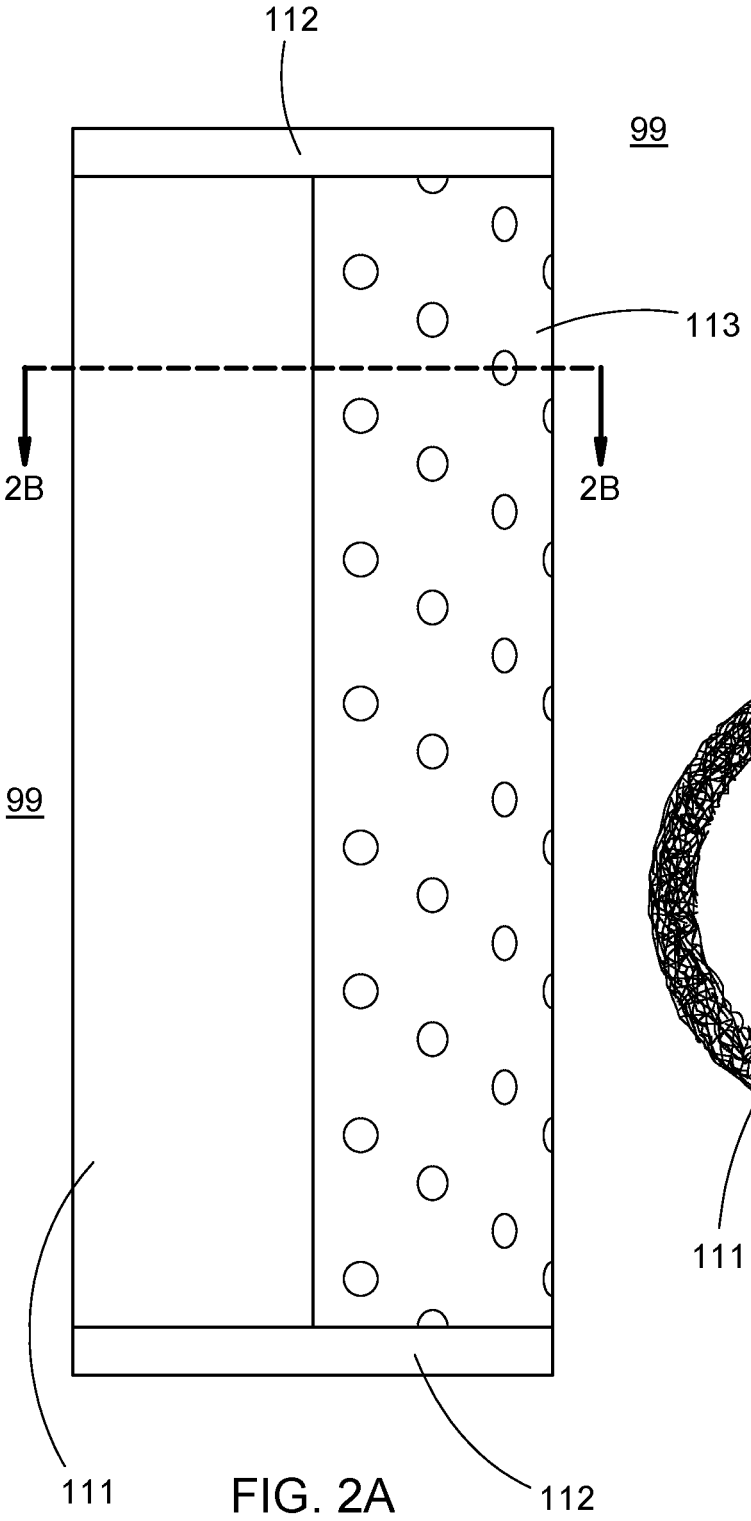
FIGS. 2A and 2B are schematic longitudinal and transverse cross-sectional views, respectively, of the conventional acoustic absorber of FIGS. 1A through 1C with a perforated sheet acting as a low-pass acoustic reflector.
Figure 2B:
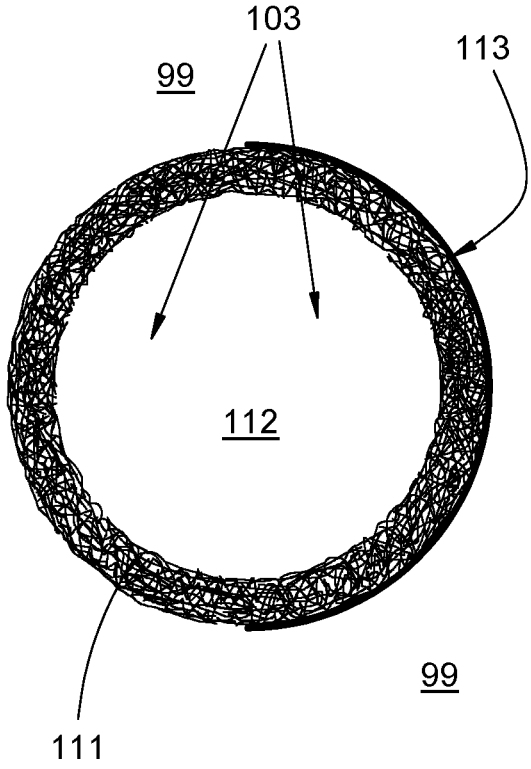

For convenience of description herein, frequencies below about 250 Hz shall be referred to herein as bass frequencies, while frequencies above about 250 Hz (i.e., so-called mid-range and treble range) shall be referred to herein collectively as treble frequencies. In many instances the desired goal of employing the tube trap is to preferentially absorb acoustic power over at least a portion of the bass frequency range. An acoustic absorber adapted or arranged to exhibit enhanced absorption over at least a portion of the bass frequency range (relative to the simple RC acoustic absorber of FIGS. 1A-1C), or decreased absorption over at least a portion of the treble frequency range (relative to the simple RC acoustic absorber of FIGS. 1A-1C), or both, may be referred to herein as a bass trap. The tube trap 100 shown in FIGS. 1A through 1C has a relatively flat absorption profile above its cut-off frequency $f_{CO}$. A further adaptation is illustrated schematically in FIGS. 2A and 2B wherein the conventional tube trap 100 includes a thin, rigid, perforated sheet 113 around a portion of the circumference of the cylindrical tube trap 100 (e.g., up to about 180° of the circumference). As disclosed in U.S. Pat. No. 4,548,292, the perforated sheet 113 can be arranged (by suitable size and density of its perforations) to preferentially transmit acoustic frequencies below a selected crossover frequency and preferentially scatter or reflect frequencies above that cross-over frequency. Such a sheet 113 may be referred to herein as a low-pass reflector. In one example (disclosed in U.S. Pat. No. 4,548,292), a sheet 113 with 0.25 inch diameter holes on 1.75 inch centers results in a crossover frequency of about 300 Hz; in another example, a sheet 113 with 1.0 inch diameter holes on 3.0 inch centers results in a crossover frequency of about 500 Hz; other suitable hole sizes, hole densities, or cross-over frequencies can be employed as needed or desired. With the tube trap 100 placed in the corner of a room with the perforated sheet 113 facing away from the corner, the tube trap 100 of FIGS. 2A and 2B exhibits an acoustic absorption spectrum resembling that the curve A of FIG. 10, which shows acoustic absorption beginning to decrease with increasing frequency above about 250 Hz. Note that the perforated sheet 113 does not enhance absorption of bass frequencies, but the resulting acoustic absorber 100 is referred to as a so-called "bass trap" based on the decrease of acoustic absorption near and above the perforated sheet's low-pass crossover frequency. Instead of the rigid perforated sheet 113, a perforated or non-perforated limp mass sheet (not shown) can be employed as a low-pass reflector or filter in other examples.

In the examples of an inventive acoustic absorber 200 illustrated schematically in FIGS. 3A-3C, 4A-4C, and 5A-5C, one or more of the chamber walls are structurally arranged so as to enable selection or adjustment of one or both of (i) the chamber volume 203 within or over a selected range of chamber volumes or (ii) area of the resistive fraction 201 of the wall area within or over a selected range of resistive areas. Selecting or adjusting one or both of the volume 203 or resistive area 201 results in a corresponding selection or alteration, for at least some acoustic frequencies below about 250 Hz, of an acoustic absorption coefficient of the acoustic absorber 200. In the simple RC-circuit model described above, the cut-off frequency $f_{CO}$ exhibited by an acoustic trap varies approximately as 1/RC, and the asymptotic maximum absorption varies approximately as 1/R. Changes to the cut-off frequency $f_{CO}$ resulting from alterations of the resistive area or the volume can be calculated based on the expected change to the observed cut-off frequency of the unaltered tube trap. For example, with only 10% of the lateral area of a cylindrical tube trap acting as the resistive fraction 201, the resulting cut-off frequency is about 1/10 of that observed for the same tube trap of the same interior volume operating with the entire lateral surface acting as the resistive area. In another example, doubling the volume of a tube trap at a constant resistive area reduces the cut-off frequency by about half.

Figure 3A:
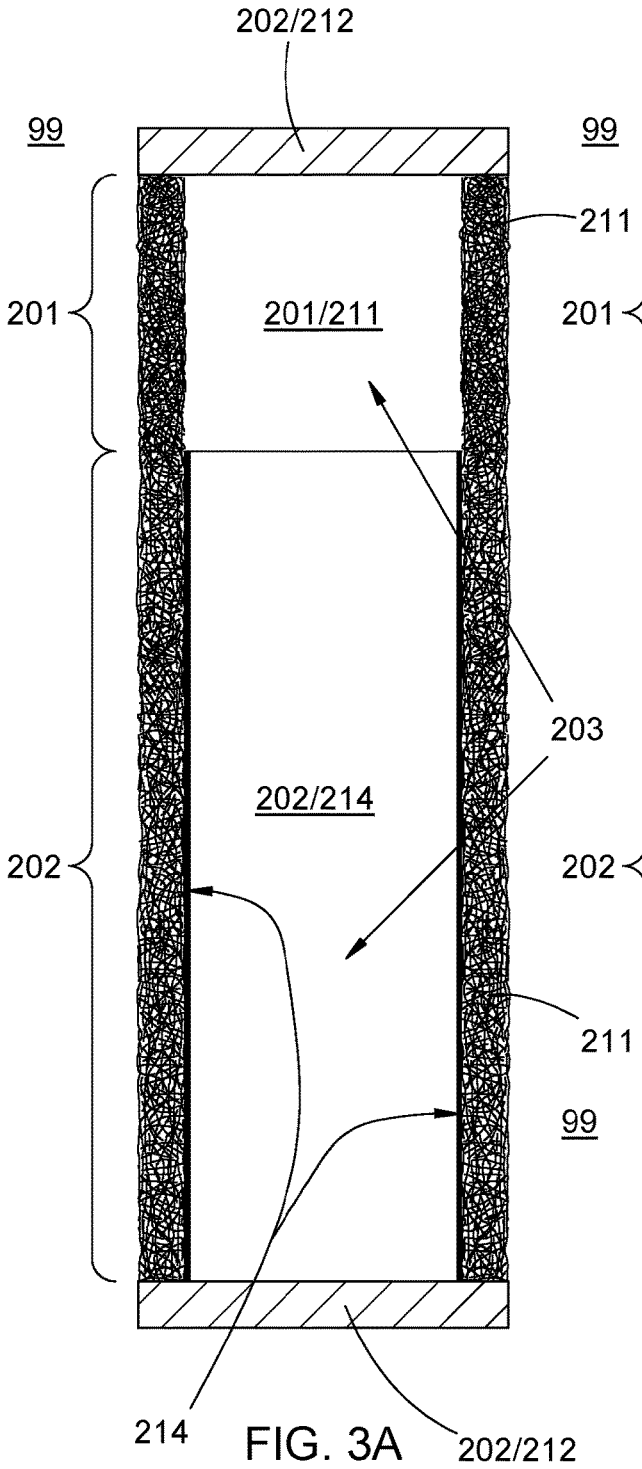
FIG. 3A is a schematic longitudinal cross-sectional view of an example inventive acoustic absorber that includes a rigid shell for obstructing a portion of the lateral resistive wall to reduce the resistive wall area.
Figure 3C:
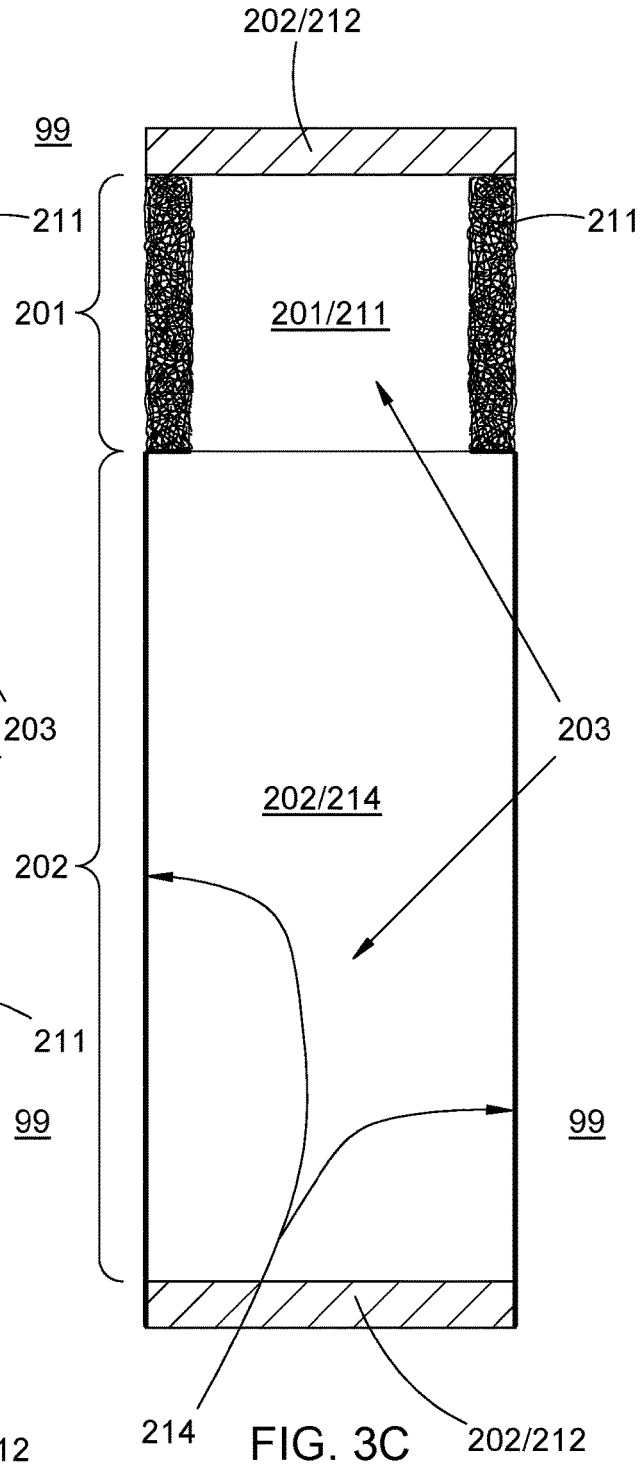
FIG. 3C is a schematic longitudinal cross-sectional view of another example inventive acoustic absorber having rigid and resistive lateral wall portions.
Figure 3B:
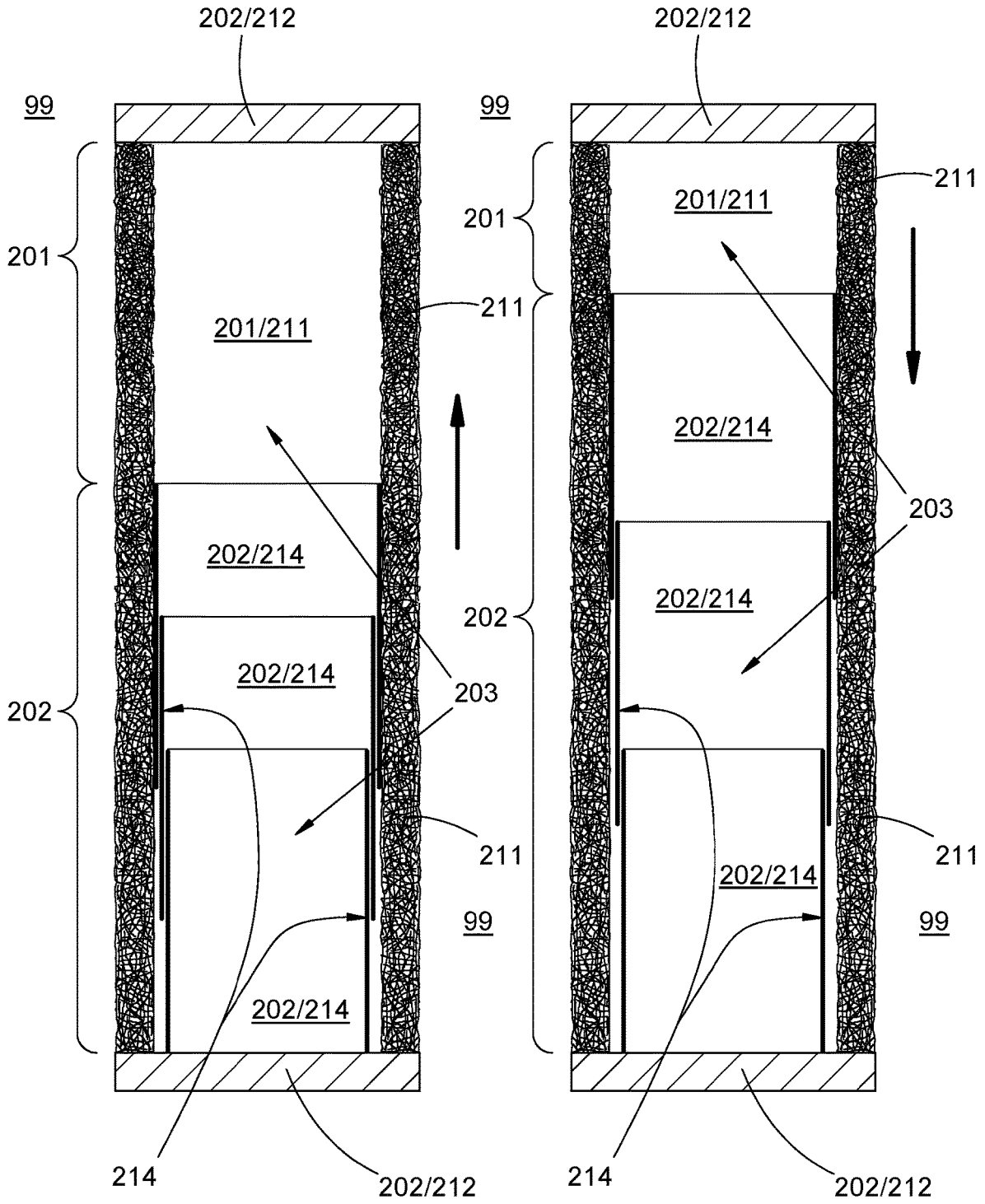
FIG. 3B is a schematic longitudinal cross-sectional view of another example inventive acoustic absorber that includes a telescoping rigid shell for adjusting the resistive wall area.

In the examples of FIGS. 3A-3C, the resistive area 201 is arranged as a circumferential ring around the cylindrical tube trap 200. The effective resistance of the acoustic absorber 200 varies inversely with the area of the ring 201 (e.g., inversely as the longitudinal extent of the ring 201 for a constant tube diameter). In the example of FIG. 3A, a relatively thin, rigid shell 214 (e.g., including compressed cardboard or other suitable material) obstructs airflow through a portion of the fibrous cylinder wall 211, so that a portion of the lateral cylinder wall is included in the obstructive fraction 202 of the wall area that obstructs airflow (typically along with the cylinder end caps 212). The circumferential ring of the fibrous wall material 211 that is left unobstructed by the shell 214 acts as the resistive fraction 201 of the wall area. The rigid shell 214 can be arranged as an internal shell positioned inside the fibrous wall material 211 (as shown) or can be arranged as an external shell positioned outside the fibrous wall material 211 (not shown). In the example of FIG. 3A, the shell 214 is arranged as a tube of a fixed length, which fixed length is selected so as to leave a selected area of the fibrous wall material 211 unobstructed as the resistive fraction 201. That selected area of the resistive fraction 201 results (along the with volume 203 of the tube trap) in a selected cut-off frequency for the tube trap 200 and corresponding acoustic absorption spectrum. In the example of FIG. 3B, the shell 214 is arranged as a telescoping tube so that the area of the resistive fraction 201 (and therefore also the cut-off frequency and absorption spectrum) can be adjusted by changing the length of the telescoping tube without substantially altering the volume 203. In the example of FIG. 3C, the fibrous wall material 211 is limited to only the resistive fraction 201 of the wall area (i.e., the circumferential ring). The remaining wall area includes only the thin, rigid shell 214 (e.g., including compressed cardboard, compressed paperboard, fiberboard, particleboard, wood, metal, plastic, or other suitable solid material that obstructs airflow and is sufficiently rigid so as to resist deformation and compression when subjected to acoustic waves, particularly in the bass frequency range). The arrangement of FIG. 3C has the advantages of (i) less fibrous wall material 211 required, thereby reducing cost and weight of the tube trap 200, (ii) a larger volume (and larger capacitance C) can be achieved within the same overall size of the tube trap 200, because the volume 203 can extend into space where fibrous wall material 211 is omitted; and (iii) the rigid shell 214 can comprise material(s) that are more structurally robust than the fibrous wall material 211.

Figure 4A:
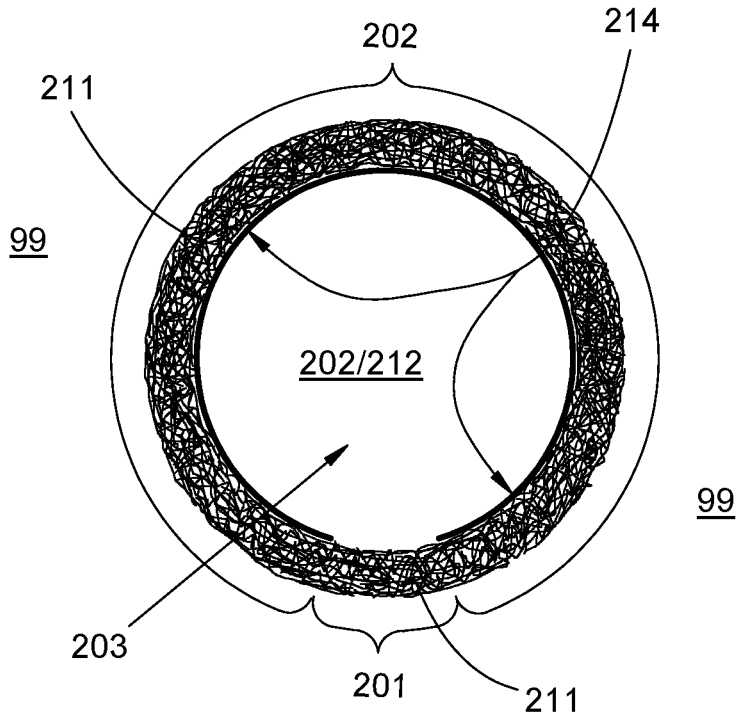
FIG. 4A is a schematic transverse cross-sectional view of another example inventive acoustic absorber that includes a rigid shell for obstructing a portion of the lateral resistive wall to reduce the resistive wall area.
Figure 4C:
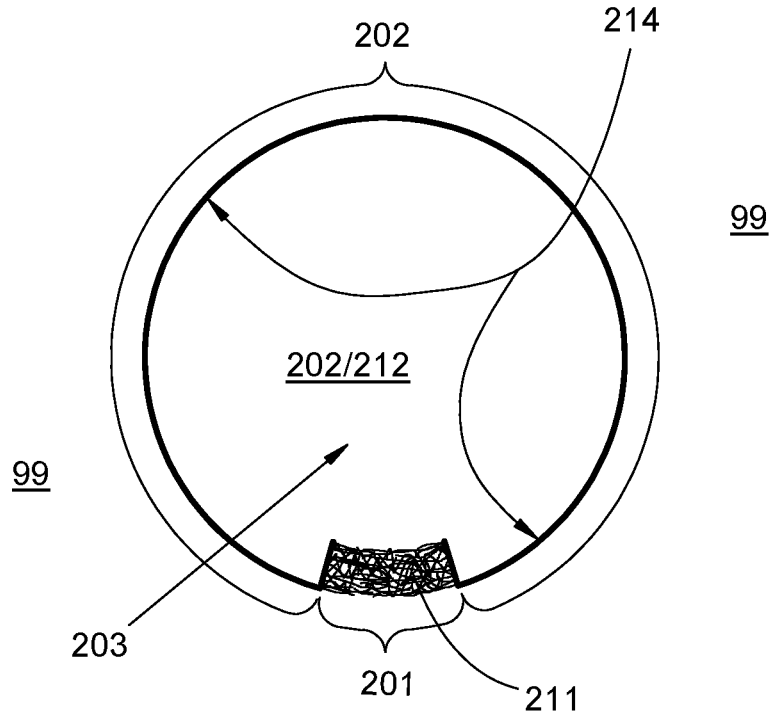
FIG. 4C is a schematic transverse cross-sectional view of another example inventive acoustic absorber having rigid and resistive lateral wall portions.

In the examples of FIGS. 4A-4C, the resistive area 201 is arranged as a longitudinal stripe along the cylindrical tube trap 200. The effective resistance of the acoustic absorber 200 varies inversely with the area of the stripe 201 (e.g., inversely as the width of the stripe 201 for a constant tube length). In the example of FIG. 4A, a relatively thin, rigid shell 214 obstructs airflow through a portion of the fibrous cylinder wall 211, so that a portion of the lateral cylinder wall is included in the obstructive fraction 202 of the wall area that obstructs airflow (typically along with the cylinder end caps 212). The longitudinal stripe of the fibrous wall material 211 that is left unobstructed by the shell 214 acts as the resistive fraction 201 of the wall area. The rigid shell 214 can be arranged as an internal shall positioned inside the fibrous wall material 211 (as shown) or can be arranged as an external shell positioned outside the fibrous wall material 211 (not shown). In the example of FIG. 4A, the shell 214 is arranged as a partial tube with a longitudinal gap of fixed width, which fixed width is selected so as to leave a selected area of the fibrous wall material 211 unobstructed as the resistive fraction 201. That selected area of the resistive fraction 201 results (along the with volume 203 of the tube trap) in a selected cut-off frequency for the tube trap 200 and a corresponding acoustic absorption spectrum. In the example of FIG. 4B, the shell 214 is arranged as overlapping shells so that the area of the resistive fraction 201 (and therefore also the cut-off frequency and absorption spectrum) can be adjusted by changing the width of the longitudinal stripe by relative rotation of the overlapping shells. In the example of FIG. 4C, the fibrous wall material 211 is limited to only the resistive fraction 201 of the wall area (i.e., the longitudinal stripe). The remaining wall area includes only the thin, rigid shell 214. The arrangement of FIG. 4C has the advantages of (i) less fibrous wall material 211 required, thereby reducing cost and weight of the tube trap 200, and (ii) a larger volume (and larger capacitance C) can be achieved within the same overall size of the tube trap 200, because the volume 203 can extend into space where fibrous wall material 211 is omitted; and (iii) the rigid shell 214 can comprise material(s) that are more structurally robust than the fibrous wall material 211.

In the examples of FIGS. 3A, 3B, 4A, and 4B, the resistive area 201 can be selected or adjusted without affecting the chamber volume 203. In those instances, the cut-off frequency $f_{CO}$ varies approximately proportionally with the area of the resistive fraction 201 (because R varies approximately inversely with the area of the resistive area 201). The proportionality constant depends on the resistivity of the fibrous wall 211 and the length and diameter of the tube trap. In the Examples of FIGS. 3C and 4C, for a fixed overall size of the tube trap, selecting a smaller resistive area 201 (and larger effective resistance R) can also result in a larger chamber volume 203 (and larger effective capacitance C), due to fibrous wall material 211 that is not needed; both of those variations together result in a stronger dependence of the cut-off frequency $f_{CO}$ on the area of the resistive fraction 201 (for FIGS. 3C and 4C, relative to that of FIG. 3A, 3B, 4A, or 4B).

Figure 5A:
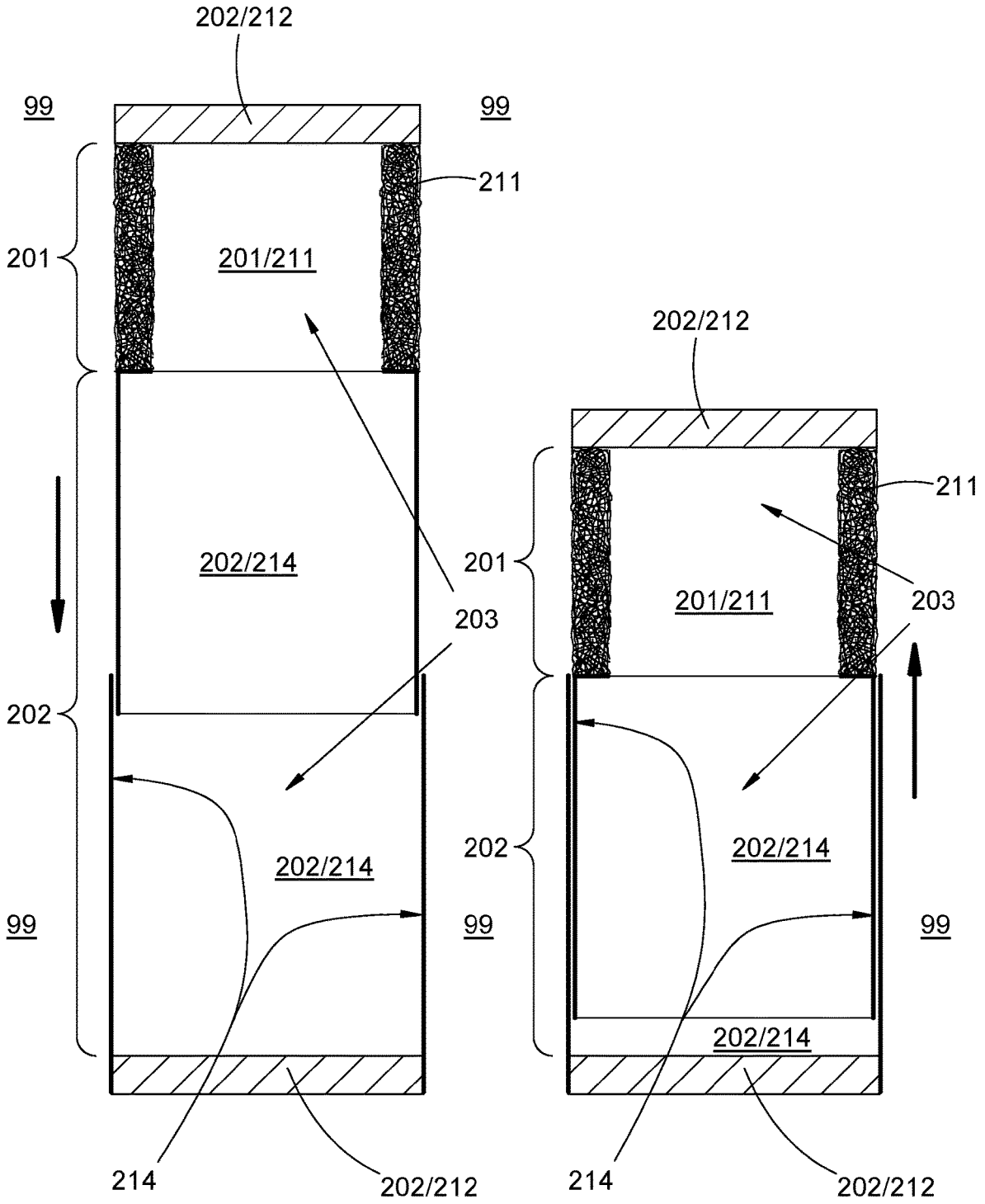
FIG. 5A is a schematic longitudinal cross-sectional view of another example inventive acoustic absorber that includes a telescoping portion for adjusting the chamber volume.
Figure 5B:
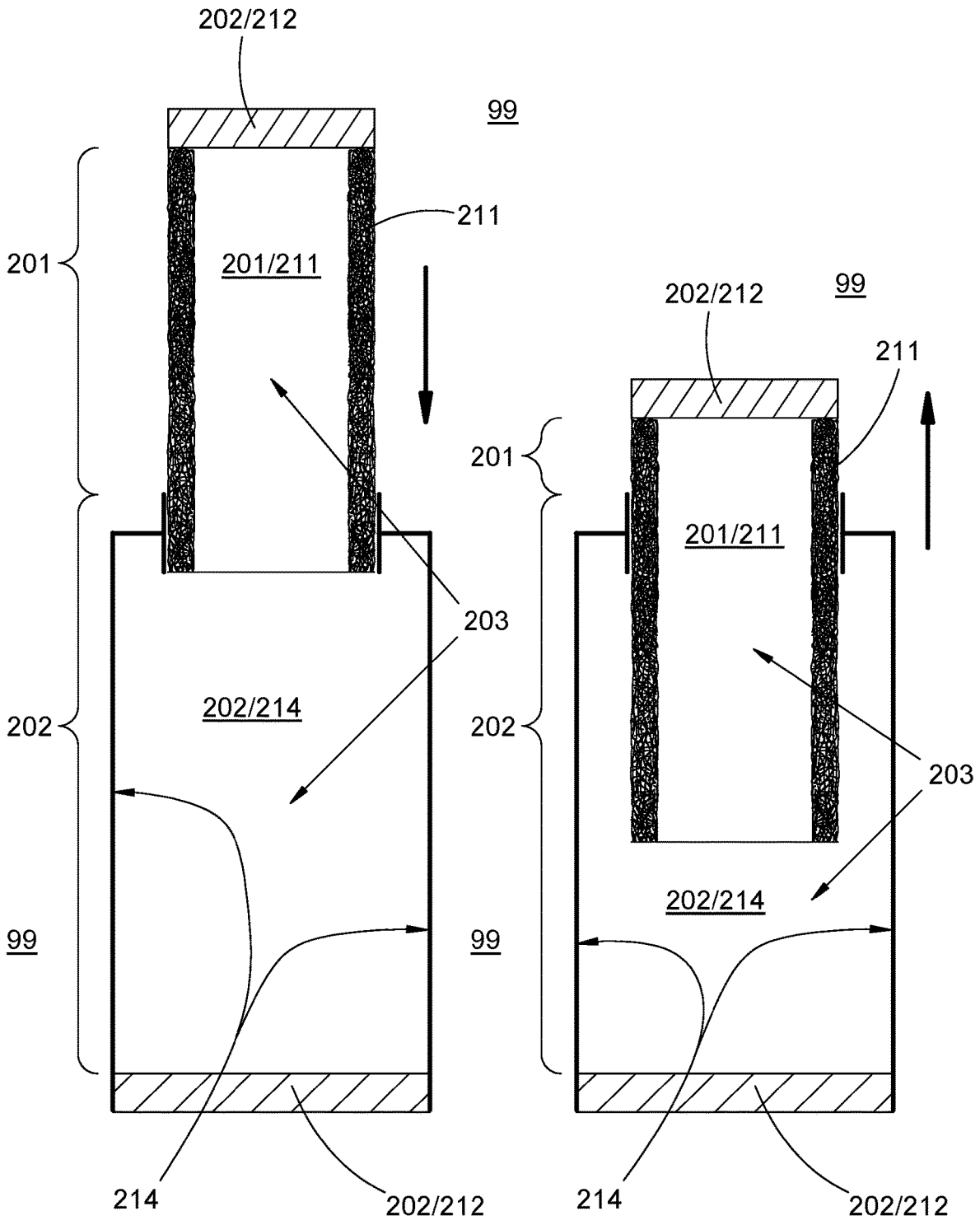
FIG. 5B is a schematic longitudinal cross-sectional view of another example inventive acoustic absorber that includes a telescoping portion for adjusting both the resistive wall area and the chamber volume.
Figure 5C:
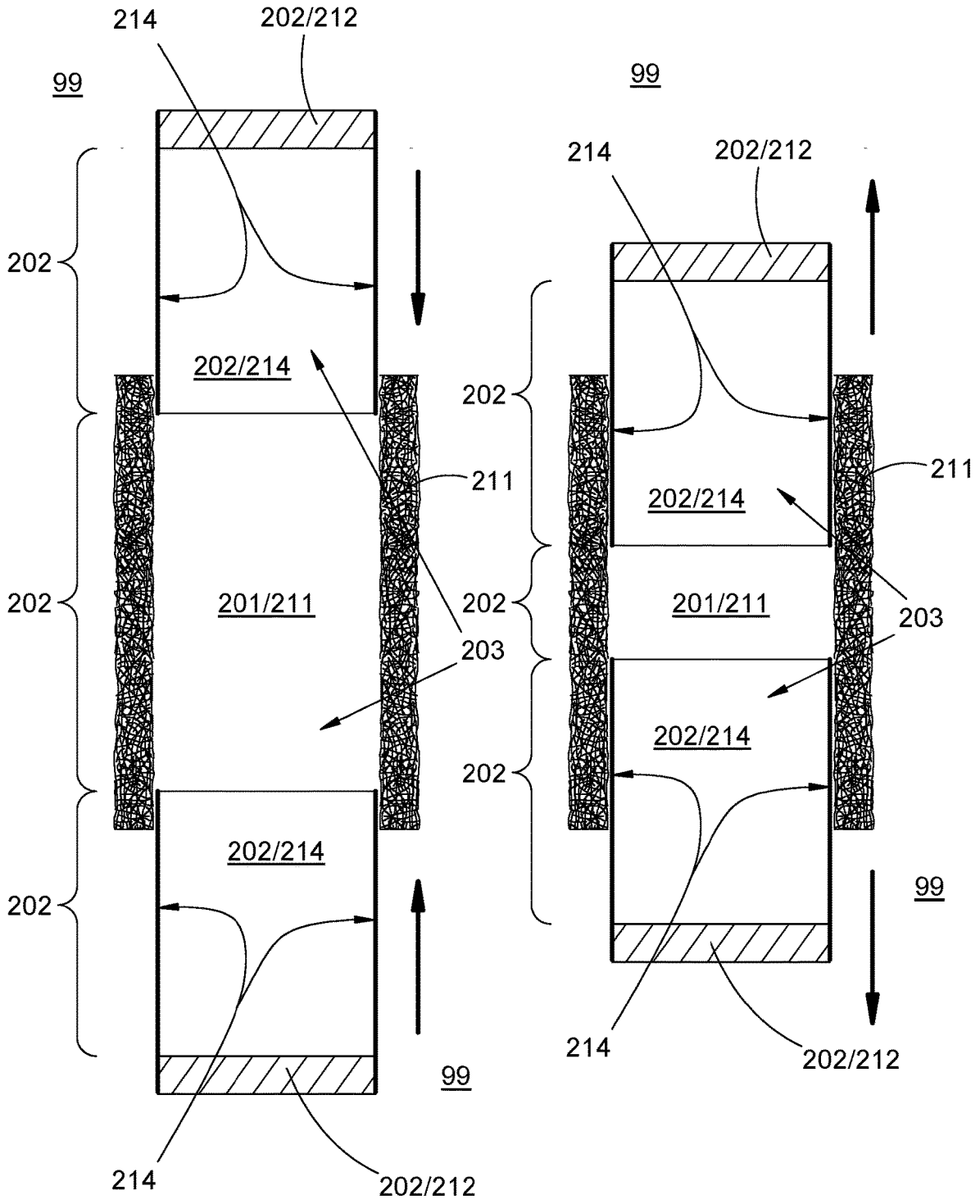
FIG. 5C is a schematic longitudinal cross-sectional view of another example inventive acoustic absorber that includes a telescoping portion for adjusting both the resistive wall area and the chamber volume.

In the example of FIG. 5A, the obstructive fraction 202 of the chamber walls includes a relatively thin, rigid, telescoping portion 214 that enables adjustment of the chamber volume 203 without altering the resistive area 201, and the cut-off frequency $f_{CO}$ varies approximately inversely with the total volume 203. In the Example of FIG. 5B, a telescoping portion includes fibrous wall material 211 and also encloses a variable portion of the chamber volume 203 while the rigid shell 214 encloses a fixed portion of the chamber volume 203. In the example of FIG. 5C, telescoping rigid shells 214 are engaged with a ring of fibrous wall material 211; the resistive area 201 lies between the shells 214. In both of the Examples of FIGS. 5B and 5C, adjustment of the telescoping portion to increase the resistive area 201 (and thereby decrease the effective resistance R) also increases the chamber volume 203 (and thereby increases the effective capacitance C), and vice versa. Those two effects (resistive and capacitive) on the cut-off frequency $f_{CO}$ partly cancel out, so that the net effect is a weaker dependence of the cut-off frequency $f_{CO}$ on the volume 203 (for FIGS. 5B and 5C, relative to FIG. 5A) or on the resistive area 201 (for FIGS. 5B and 5C relative to FIG. 3B). The degree to which the two effects cancel out depends on the relative volumes of the telescoping and fixed portions of the volume 203. In the arrangement of FIG. 5B, the telescoping volume is the volume within the movable tube of resistive wall material 211; in the arrangement of FIG. 5C, the telescoping volume is that portion of the interior volume surrounded by the resistive fraction 201 of the fibrous wall material 211 between the two rigid shells 214. For a telescoping volume that is smaller relative to the fixed volume (relatively narrow fibrous tube diameter in FIG. 5B; relatively long rigid shells 214 in FIG. 5C), there is relatively less variation in the total volume 203 with movement of the telescoping position, less cancellation of the resistive effect by the capacitive effect, and a stronger dependence of the cut-off frequency $f_{CO}$ on the resistive effect. Conversely, for a telescoping volume that is larger relative to the fixed volume (relatively wide fibrous tube diameter in FIG. 5B; relatively short rigid shells 214 in FIG. 5C), there is relatively more variation in the total volume 203 with movement of the telescoping portion, more cancellation of the resistive effect by the capacitive effect, and a weaker dependence of the cut-off frequency $f_{CO}$ on the resistive effect. The relative cancelation of the capacitive and resistive effects can be readily determined from the relative dimensions of the various portions of the acoustic absorber 200. In examples wherein the two effects nearly completely cancel out, the cut-off frequency $f_{CO}$ can be tuned relatively precisely, albeit over a relatively limited range.

In conventional tube traps acting as an RC-type absorber (with or without a low-pass reflector), acoustic absorption decreases with decreasing frequency beginning somewhat above the cut-off frequency and rolling off with decreasing frequency at about 6 dB/octave. However, it is at those low frequencies (i.e., so-called "deep bass" frequencies, e.g., below 50 to 60 Hz) where acoustic absorption typically is most desirable for improving the acoustic characteristics of a room or other acoustic space. It would be desirable to increase absorption at those deep-bass frequencies, particularly if that could be achieved without increasing the overall size of the acoustic absorber. Reducing the cut-off frequency by increasing the effective RC time constant of the tube trap 200 shifts the acoustic absorption spectrum to lower frequencies. One way to decrease the cut-off frequency is by increasing the capacitance of the tube trap 200 by increasing its volume. That approach may be undesirable in some instances due to the increased size, weight, and expense required to construct larger and larger tube traps.

Some of the examples of FIG. 3A-3C, 4A-4B, or 5A-5B offer an alternative way to decrease the cut-off frequency of the tube trap 200, and thereby increase acoustic absorption at deep bass frequencies, without necessarily increasing the size of the acoustic absorber 200. An absorption spectrum of a conventional RC-type tube trap 100, characterized by a cut-off frequency $f_{CO}$, is indicated by curve A of FIG. 6, in which acoustic power absorption P (dB, relative to the asymptotic maximum absorption $P_{MAX}$ at high frequency without a low-pass reflector 113) is plotted as a function of $\log(f/f_{CO})$. To simplify the comparison no low-pass reflector is employed in this example to decrease absorption of higher frequencies; such a filter can be employed and, if employed, would decrease absorption above its cross-over frequency, as discussed above. The curves B, C, and D of FIG. 6 are acoustic absorption spectra for the inventive tube traps 200 for which the conventional tube trap 100 that generated curve A is modified in each case to reduce the resistive area 201 (according to any of the examples of FIG. 3A-3C, 4A-4C, or 5A-5C) to 30%, 20%, and 10% of the original resistive area 101, respectively, while leaving the chamber volume 203 about equal to the original chamber volume 103. The curves B, C, and D are relative power absorption P (dB, relative to the asymptotic maximum absorption $P_{MAX}$ of the conventional tube trap 100 of curve A) plotted as a function of $\log(f/f_{CO})$, where $f_{CO}$ is the cut-off frequency of the conventional tube trap 100 of curve A. Reducing the resistive area increases the effective acoustic resistance, which in turn reduces the cut-off frequency (varies as 1/R at constant C) and also reduces the high-frequency asymptotic acoustic absorption maximum (also varies as 1/R). However, at frequencies below the unmodified cut-off frequency $f_{CO}$, the tube traps 200 with reduced resistive areas 201 exhibit increased absorption relative to the unmodified tube trap 100. For example, two octaves below the unmodified cut-off frequency $f_{CO}$ (i.e., at about −0.6 on the horizontal axis), curves B and C indicate the corresponding modified tube traps 200 exhibit roughly twice the absorbance of the unmodified tube trap 100 (i.e., about 3 dB above curve A). Somewhat more than three octaves lower than $f_{CO}$ (i.e., at about −1.0 on the horizontal axis), curve D indicates the corresponding modified tube trap 200 exhibits roughly 5 times the absorbance of the unmodified tube trap 100 (i.e., about 7 dB above curve A).

As shown in FIG. 6, the increased resistance that can be achieved using some of the modified tube traps 200 of FIG. 3A-3C, 4A-4C, or 5A-5C reduces the high-frequency asymptotic maximum absorption of those traps. Consequently, in many instances it may not be necessary to employ a low-pass reflector as in the example tube trap 100 of FIGS. 2A and 2B. However, such a low-pass reflector can be employed in any of those example tube traps 200 if suitable, needed, or desired.

Figure 7A:
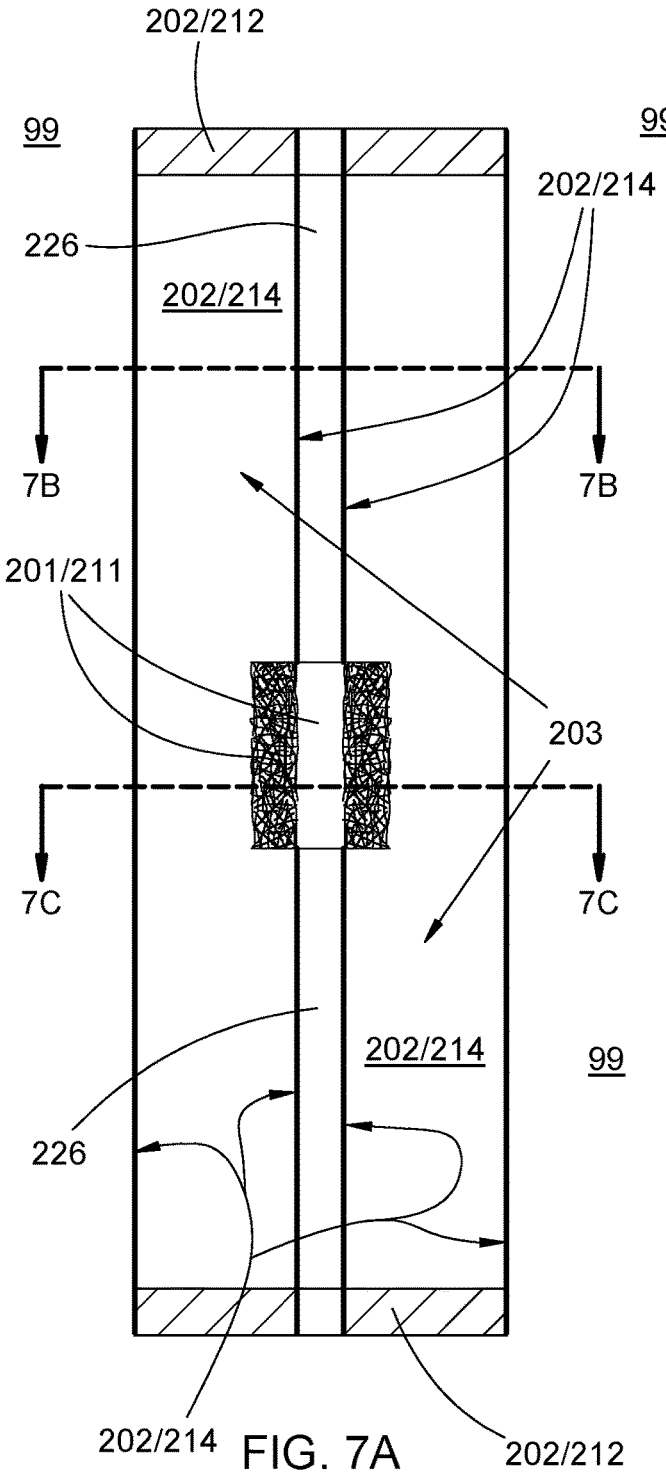
FIGS. 7A, 7B, and 7C are schematic longitudinal and two transverse cross-sectional views, respectively, of another example acoustic absorber having the resistive wall portion within a passage.
Figure 7B:
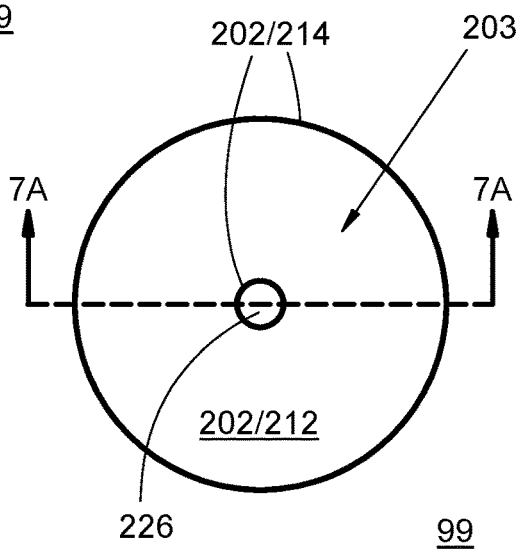
Figure 7C:
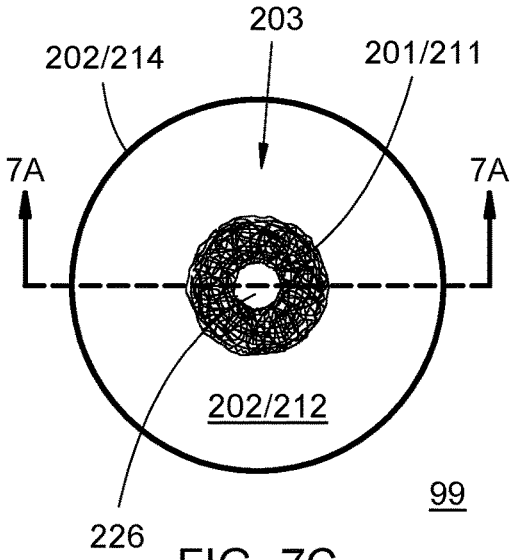

In the example acoustic absorber 200 illustrated schematically in FIGS. 7A, 7B, and 7C, the chamber is arranged with a passage 226 protruding into or through the chamber volume 203. The passage is open at one end and can be open at both ends to communicate directly with the ambient air 99. In some examples, an acoustic horn of any suitable type, shape, or arrangement (e.g., exponential, cone, waveguide, and so forth) can be employed at the opening of the passage 226. A typically arrangement is a roughly coaxial passage 226 within a cylindrical tube trap 200. The resistive fraction 201 of the wall area is arranged and positioned entirely within the passage 226, and forms a portion of the wall area separating the passage 226 from the chamber volume 203. As with the other disclosed examples, the chamber volume 203 communicates with the ambient air 99 (in this arrangement, ambient air 99 that fills the passage 226) only through the resistive area 201. The arrangement of FIGS. 7A through 7C offers several advantages. First, like the examples described above, by making the resistive area relatively small, the effective cut-off frequency $f_{CO}$ can be pushed to deep bass frequencies without a need to enlarge the chamber volume 203 and the overall size of the absorber 200. Because the resistive area 201 is small, it can be placed inside the passage 226 and thereby removed from outer portions of the chamber walls that must structurally support the acoustic absorber 200. In the conventional examples of FIGS. 1A-1C, 2A, and 2B, the fibrous wall material 111 typically cannot provide sufficient structural support for the tube trap 100, and additional reinforcement must be provided (often in the form of a stiff wire mesh). In the arrangement of the tube trap 200 of FIGS. 7A through 7C, the entire outer surface can be made of a rigid shell 214 of any stiff, structurally robust material desired, and is included in the obstructive fraction 202 of the chamber walls. Materials can be chosen for light weight, stiffness or strength, appearance, or other properties or characteristics, without the need to consider the limitations imposed by the fibrous wall material 211. That fibrous material 211 is tucked away within the passage 226 and can essentially be ignored with respect to structural considerations. Significant cost savings can be realized too, because the fibrous wall material 211 typically is more expensive than materials employed for structural support and that obstruct airflow.

An additional advantage resulting from the arrangement of FIGS. 7A through 7C is reduced undesirable absorption of higher acoustic frequencies (e.g., above 300 Hz). The relatively small transverse dimensions of the passage 226 preferentially admit for absorption a higher fraction of incident acoustic energy at acoustic frequencies below about 250 Hz or 300 Hz, relative to acoustic energy admitted at higher acoustic frequencies. That discrimination can obviate the need for, e.g., a low-pass reflector to reduce absorption of those higher frequencies. Typical size of the passage 226 can include a cross-sectional area, e.g., between about 1 and about 5 square inches, or typically between about 2 and about 4 square inches. In one specific example a passage 226 about 3 square inches in transverse extent passes roughly coaxially through a 16 inch diameter tube trap 200.

A further adaptation can be made to enhance acoustic absorption a frequencies below about 250 Hz without a need to enlarge the overall size of the acoustic absorber 200. In the Examples of FIGS. 8A, 8B, 9A, and 9B, some or all of the chamber volume 203 is occupied by a fibrous filler material 234. The density of the fibrous filler material 234 is less than that of the fibrous wall material 211, and is sufficiently small so as to exhibit only negligible resistance to airflow and only negligible absorption of acoustic energy. The density and heat capacity of the fibrous filler material 234 results in the occupied fraction of the chamber volume 234 exhibiting compressibility of air within the chamber, for at least acoustic frequencies up to about 50 Hz, that is larger than adiabatic compressibility of air. For sufficiently low acoustic frequencies (e.g., less than about 50 Hz), that larger compressibility exhibited by the occupied fraction of the chamber volume 203 results in the acoustic absorber 200 exhibiting an acoustic absorption coefficient that is at least 50% larger, up to about 100% larger, than that of an otherwise identical absorber that does not include the fibrous filler material 234. In some examples even larger enhancements of the absorption coefficient can be achieved, if additional adaptations are employed (see below).

An extensive discussion of possible mechanisms for the increased compressibility of air in a chamber volume 203 with the filler material 234 is presented in provisional App. No. 62/375,840 filed Aug. 16, 2016 and incorporated above. That discussion need not be repeated here, and the accuracy or applicability of that discussion does not alter the scope or validity of the subject matter disclosed or claimed herein. In brief, the effective capacitance of the chamber volume 203 is proportional to its compressibility. For typical acoustic frequencies and with no filler material 234, the effective capacitance of the chamber volume 203 is proportional to the adiabatic compressibility of the air filling the chamber. Thermal conductivity of air is too slow to allow thermal equilibration on the timescales of acoustic vibrations, so that the adiabatic compressibility is applicable. However, the fibrous filler material 234 can act as a diffuse heat sink within the chamber volume 234. Heat generated by acoustic compression within a small volume or air surrounding each filament can be absorbed into the fiber, and then returned to the surrounding air upon subsequent rarefaction; that cycle is repeated with each passing pressure crest of the passing acoustic wave. The small air volume, which is micron-scale in transverse extent and decreases in size with increasing acoustic frequency, behaves according to its isothermal compressibility, which is $\gamma$=1.4 times larger than the adiabatic compressibility for air. As the filament density increases and the average spacing between filaments decreases, a larger fraction of the chamber volume 203 acts according to its isothermal compressibility instead of the adiabatic compressibility, and the effective capacitance of the chamber volume 203 (or at least that portion occupied by the fibrous filler material 234) increases from its adiabatic value toward its isothermal value (about 1.4 time larger). When the filament density becomes sufficiently large, and the corresponding average distance between filaments becomes sufficiently small, the entire occupied fraction of the chamber volume 203 behaves according to its isothermal compressibility, because every portion of the air is sufficiently close to a filament to remain in thermal equilibrium with it during the acoustic pressure oscillations. However, further increases in filament density can lead to undesirable reduction of the compliant air volume, undesirable resistance to airflow, or undesirable acoustic absorption by the filler material 234.

The description in the preceding paragraph necessarily includes a dependence on acoustic frequency. With decreasing acoustic frequency, the effectively isothermal volume around each filament is larger, and fully isothermal behavior can be observed at correspondingly lower filament density and larger average filament spacing. By increasing the compressibility from its adiabatic value toward its isothermal value (up to a 1.4 times increase), the corresponding capacitance increases by a similar factor, the cut-off frequency decreases by a similar factor, and absorption of acoustic energy at frequencies below the cut-off frequency increases by the square of that factor (up to a two-fold increase). Conversely, with increasing acoustic frequency, the effectively isothermal volume around each filament is smaller, and fully isothermal behavior requires correspondingly higher filament density and smaller average filament spacing. For a given filament density, the volume 203 will exhibit isothermal behavior at sufficiently low acoustic frequencies, adiabatic behavior at sufficiently high acoustic frequencies, and a transition between those behaviors at intervening frequencies. At filament densities typically employed (see below), some transition toward isothermal behavior begins at acoustic frequencies below about 250 Hz; isothermal behavior becomes more pronounced at acoustic frequencies below about 100 Hz, and predominates at acoustic frequencies below about 50 Hz.

Figure 8A:
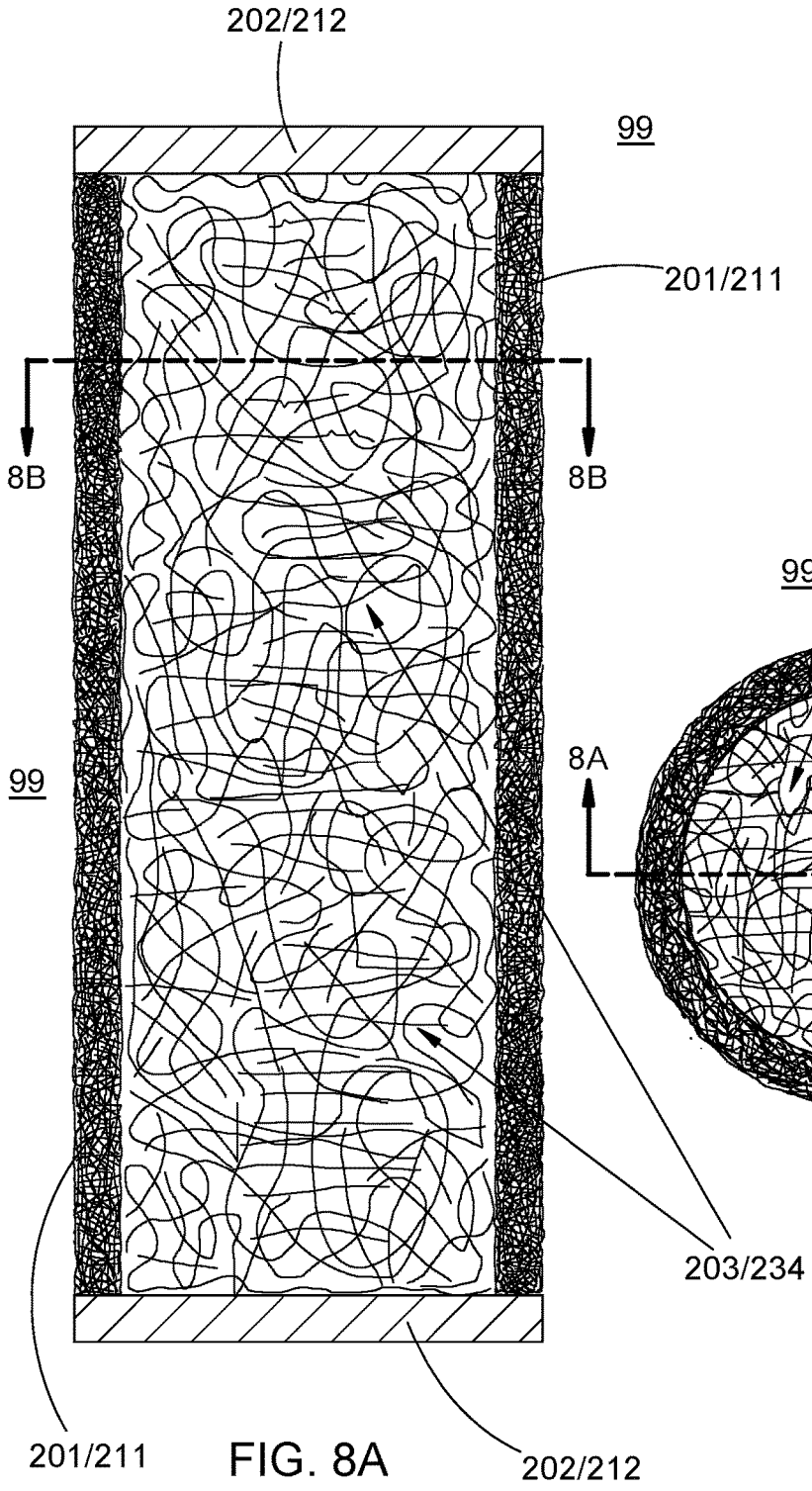
FIGS. 8A and 8B are schematic longitudinal and transverse cross-sectional views, respectively, of another example inventive acoustic absorber that includes fibrous filler material occupying the entire chamber volume.
Figure 8B:
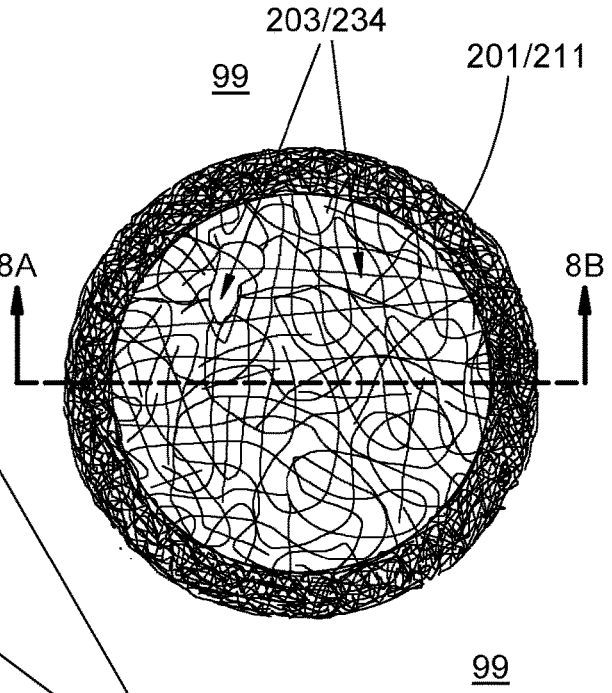
Figure 10:
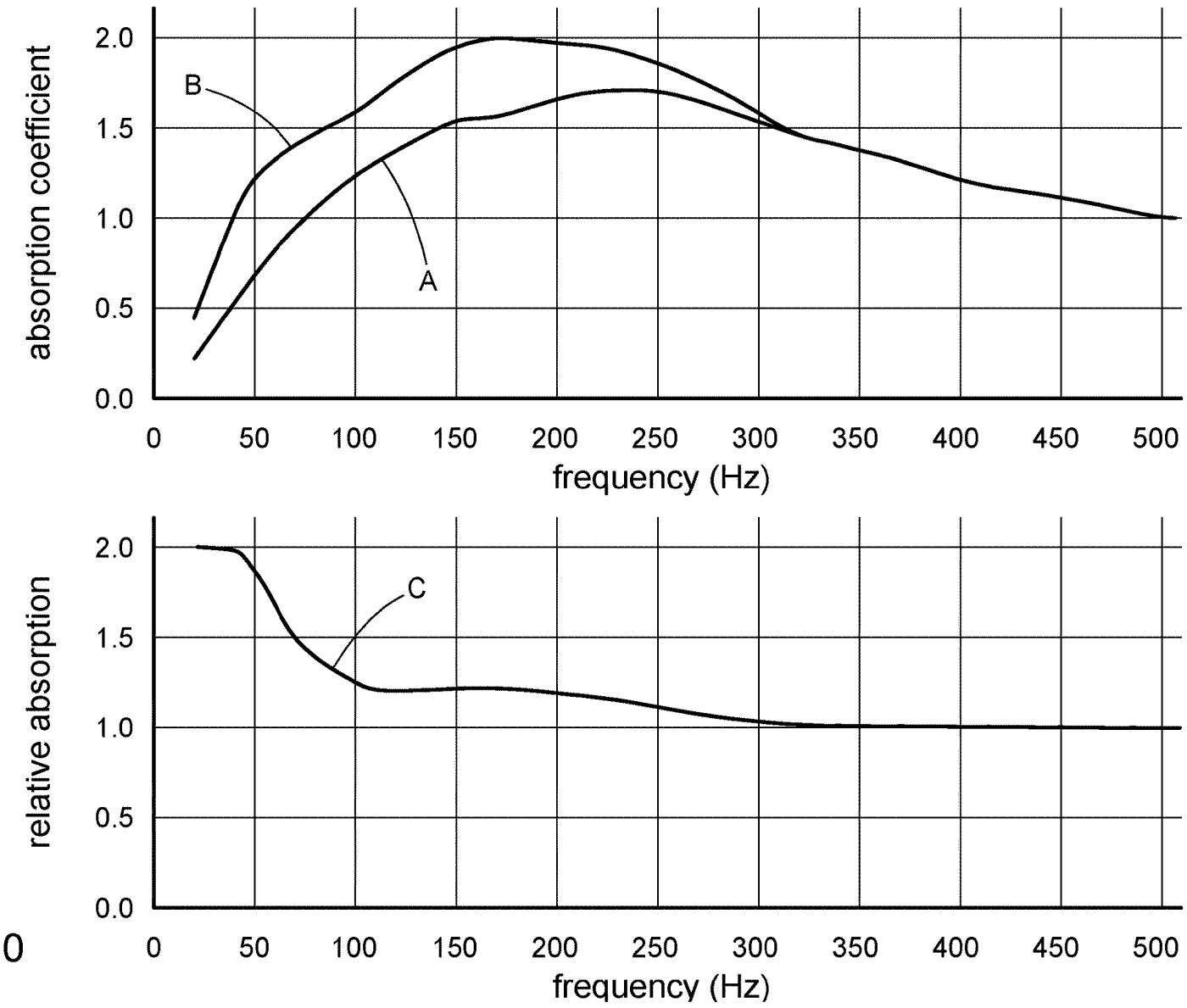
FIG. 10 illustrates schematically examples of acoustic absorption spectra exhibited by various example conventional and inventive acoustic absorbers.

A comparison is shown in FIG. 10 between a conventional tube trap 100 (as in FIGS. 2A and 2B; curve A) and an otherwise identical tube trap 200 with an interior volume 203 filled with the fibrous filler material 234 (as in FIGS. 8A and 8B; curve B). For frequencies above about 300 Hz, the acoustic absorption of the two devices are essentially identical. For acoustic frequencies below about 50 Hz, an acoustic absorption coefficient of the inventive tube trap 200 of FIGS. 8A and 8B exceeds that of the conventional tube trap 100 of FIGS. 2A and 2B by at least 50% (approaching 100% for frequencies below about 30 Hz; curve C). For acoustic frequencies up to about 100 Hz, the acoustic absorption coefficient of the inventive tube trap 200 exceeds that of the conventional tube trap 100 by at least 20%. For acoustic frequencies up to about 250 Hz, the acoustic absorption coefficient of the inventive tube trap 200 exceeds that of the conventional tube trap 100 by at least 10%. The inventive tube trap 200 of FIGS. 8A and 8B exhibits significant enhancement of acoustic absorption, particularly at low, deep-bass frequencies less than about 50 Hz (approaching a factor of two times greater absorption of acoustic energy), relative to its conventional predecessors, and achieves that enhanced low-frequency performance without increasing the overall size of the tube trap 200.

Figure 9A:
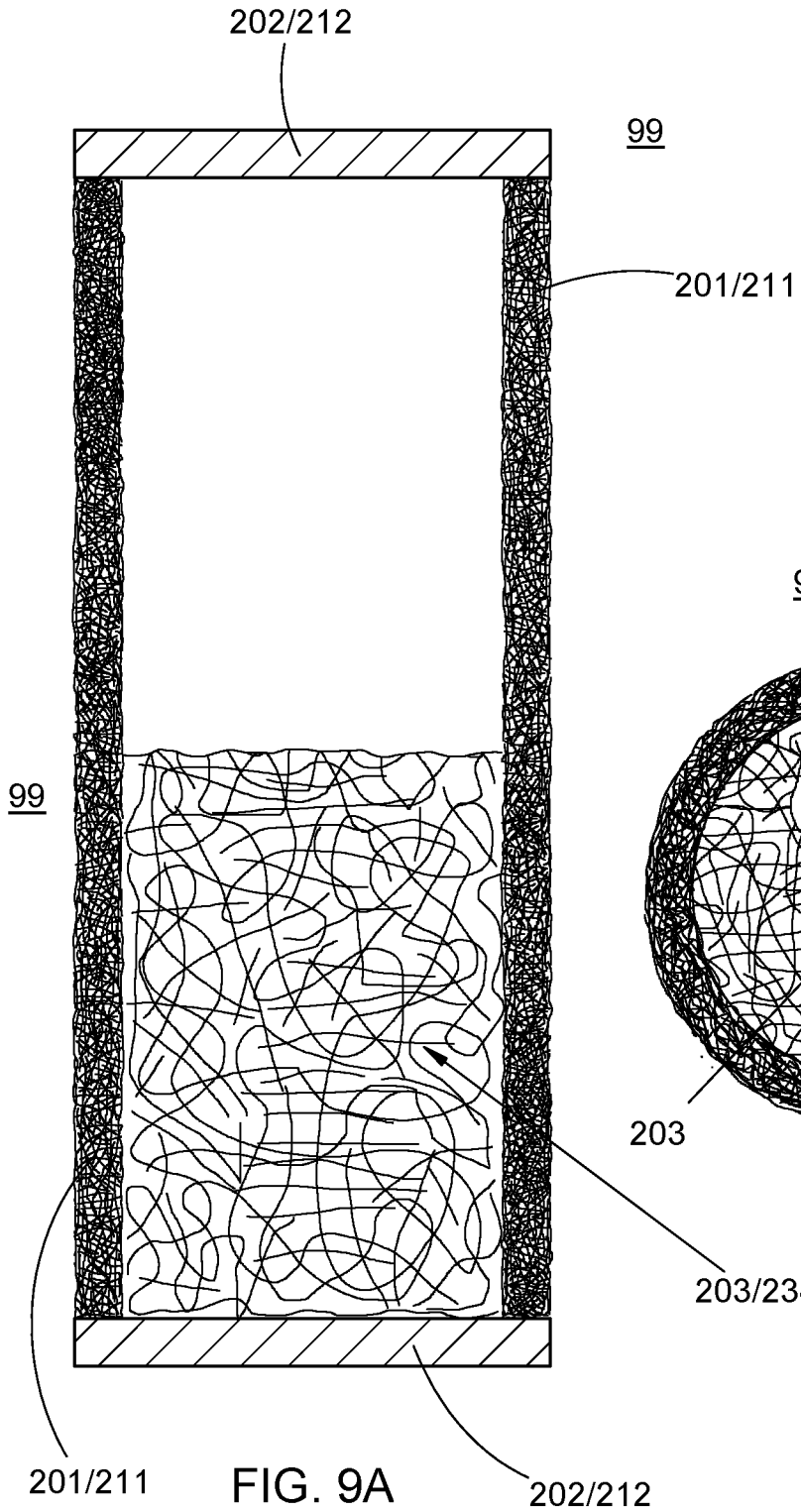
FIG. 9A is a schematic longitudinal cross-sectional view of another example inventive acoustic absorber that includes fibrous filler material occupying only a fraction of the chamber volume.
Figure 9B:
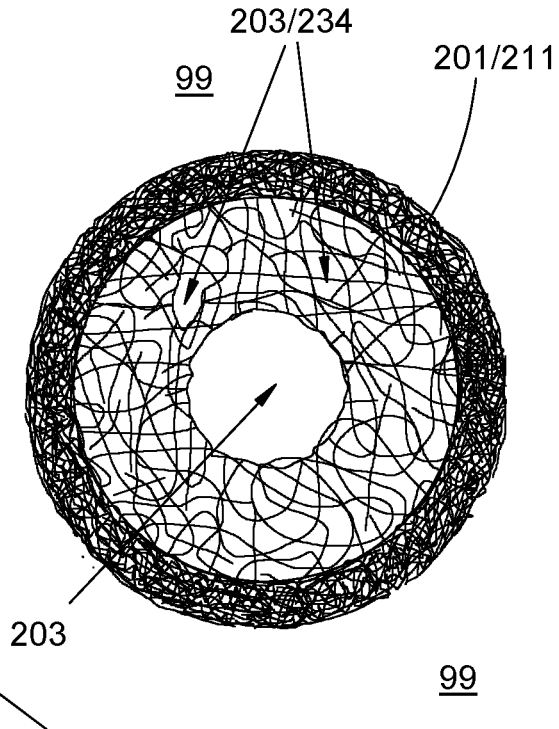
FIG. 9B is a schematic transverse cross-sectional view of another example inventive acoustic absorber that includes fibrous filler material occupying only a fraction of the chamber volume.

In some examples (FIGS. 8A and 8B), the chamber volume 203 is substantially entirely filled with the fibrous filler material 234. In some examples (FIGS. 9A and 9B), the chamber volume 203 is only partly filled with the fibrous filler material 234. In FIG. 9A the filler material 234 extends only along a portion of the length of the tube trap 200; in FIG. 9B the filler material only extends radially partly across the tube trap 200. The overall behavior of such partial-fill tube traps 200 is intermediate between adiabatic and isothermal behaviors, and depends on the filament density and heat capacity (as above) and also on the fraction of the volume 203 occupied by the filler material 234. In some examples, the tube trap 200 can be structurally arranged so as to enable adjustment of the occupied fraction of the chamber volume 203. Adjustment of the occupied fraction results in a corresponding alteration, over at least a portion of acoustic frequencies up to about 250 Hz, of acoustic absorption by the tube trap 200.

In some examples the fibrous filler material 234 comprises glass fibers at a density between about 0.2 $lb/ft^3$ and about 0.8 $lb/ft^3$; in some of those examples, the glass fibers are at a density between about 0.4 $lb/ft^3$ and about 0.6 $lb/ft^3$. Other suitable fibrous filler material can be employed (e.g., mineral wool) that exhibits sufficient thermal conductivity and heat capacity to result in the desired alteration of the compressibility. In some examples, the mean distance between individual fibers of the fibrous filler material 234 is between about 20 μm and about 500 μm; in some of those examples, the mean distance between individual fibers of the fibrous filler material is between about 50 μm and about 250 μm. In some examples, the fibrous filler material 234 is characterized by a mean fiber diameter between about 1 μm and about 50 μm; in some of those examples, the fibrous filler material is characterized by a mean fiber diameter between about 3 μm and about 25 μm.

In another example, the fibrous filler material 234 is contained within a fluid-tight flexible bag along with a fluid exhibiting a gas-liquid phase transition in response to air pressure outside the bag; that arrangement leads to nearly isobaric behavior of the chamber volume 203. In another example that can exhibit nearly isobaric behavior, the fibrous filler material 234 includes granular activated charcoal.

In some examples, the inventive tube trap 200 can includes one or more internal bulkheads positioned within the chamber volume. Those can be employed for strictly structural purposes, e.g., to increase stiffness or weight-bearing capacity, or can be employed to alter the acoustic characteristics of the tube trap 200. In some examples, at least one such bulkhead can substantially obstruct airflow, effectively dividing the chamber volume 203 into two of more subvolumes. In other examples, at least one bulkhead can permits airflow therethrough, perhaps through a restrictive or adjustable orifice. If adjustable, such an orifice can be adjusted manually, or controlled electronically, to enable some tuning of the frequency-dependent acoustic absorption.

Any of the examples of FIG. 3A-3C, 4A-4C, 5A-5C, 7A, 7B, 8A, 8B, 9A, or 9B can include a low-pass reflector, such as the perforated sheet described above for the example of FIGS. 2A and 2B, if suitable, needed, or desired. Any examples that include such a low-pass reflector shall fall within the scope of the present description or appended claims. As already noted, in some arrangements of the examples of FIG. 3A-3C, 4A-4C, 5A-5C, 7A, or 7B, such a low-pass reflector may be rendered unnecessary. Any of the examples of FIG. 3A-3C, 4A-4C, 5A-5C, 7A, 7B, 8A, 8B, 9A, or 9B can include, if suitable, needed, or desired, a coupled Helmholtz resonator as disclosed in U.S. Pat. No. 5,210,383. The resonant frequency of the coupled resonator can be selected or tuned to modify the absorption spectrum of any inventive tube trap 200 disclosed or claimed herein. Any examples that include such a coupled resonator shall fall within the scope of the present description or appended claims.

Any of the inventive acoustic absorber disclosed or claimed herein can be employed to at least partly absorb acoustic energy that can be characterized as including one or more of transient, impulsive, sustained, or tonal acoustic energy.

In addition to the preceding, the following examples fall within the scope of the present disclosure or appended claims:

Example 1

An apparatus for absorbing acoustic energy, the apparatus comprising one or more chamber walls that form an enclosed chamber, wherein: (a) the one or more chamber walls define an interior volume characterized by a chamber volume and a wall area; (b) a first, non-zero fraction of the wall area permits resistive airflow therethrough, and the chamber volume communicates with ambient air only through the resistive fraction of the wall area; (c) one or more of the one or more chamber walls are structurally arranged so as to enable selection or adjustment of one or both of (i) the chamber volume over a selected range of chamber volumes or (ii) area of the resistive fraction of the wall area over a selected range of resistive areas; and (d) the selection or adjustment of one or both of the chamber volume or the resistive area results in a corresponding selection or alteration, for at least acoustic frequencies less than about 250 Hz, of an acoustic absorption spectrum of the apparatus.

Example 2

An apparatus for absorbing acoustic energy, the apparatus comprising one or more chamber walls that form an enclosed chamber, wherein: (a) the one or more chamber walls define an interior volume characterized by a chamber volume and a wall area; (b) a first, non-zero fraction of the wall area permits resistive airflow therethrough, and the chamber volume communicates with ambient air only through the resistive fraction of the wall area; (c) a second, non-zero fraction of the wall area substantially obstructs airflow therethrough; and (d) the chamber walls are arranged to form a cylinder, the resistive fraction of the wall area is arranged as one or more circumferential rings around the cylinder, and the obstructive fraction of the wall area includes both ends of the cylinder and a remaining portion of a lateral surface of the cylinder not occupied by the resistive fraction.

Example 3

An apparatus for absorbing acoustic energy, the apparatus comprising one or more chamber walls that form an enclosed chamber, wherein: (a) the one or more chamber walls define an interior volume characterized by a chamber volume and a wall area; (b) a first, non-zero fraction of the wall area permits resistive airflow therethrough, and the chamber volume communicates with ambient air only through the resistive fraction of the wall area; (c) a second, non-zero fraction of the wall area substantially obstructs airflow therethrough; and (d) wherein the chamber walls are arranged to form a cylinder, the resistive fraction of the wall area is arranged as one or more longitudinal stripes along the cylinder, and the obstructive fraction of the wall area includes both ends of the cylinder and a remaining portion of a lateral surface of the cylinder not occupied by the resistive fraction.

Example 4

An apparatus for absorbing acoustic energy, the apparatus comprising one or more chamber walls that form an enclosed chamber, wherein: (a) the one or more chamber walls define an interior volume characterized by a chamber volume and a wall area; (b) a first, non-zero fraction of the wall area permits resistive airflow therethrough, and the chamber volume communicates with ambient air only through the resistive fraction of the wall area; (c) a second, non-zero fraction of the wall area substantially obstructs airflow therethrough; and (d) wherein the chamber walls are arranged to form a cylinder with an axial passage therethrough that is filled with ambient air, the resistive fraction of the wall area is arranged entirely within the axial passage, and the obstructive fraction of the wall area includes both ends of the cylinder, the entire lateral surface of the cylinder, and a remaining portion of the axial passage not occupied by the resistive fraction.

Example 5

The apparatus of any one of Examples 1 through 4 further comprising fibrous filler material, wherein: (e) at least a fraction of the chamber volume is occupied by the fibrous filler material; (f) density of the fibrous filler material is sufficiently small so as to exhibit only negligible resistance to airflow and only negligible absorption of acoustic energy; (g) density and heat capacity of the fibrous filler material results in the occupied fraction of the chamber volume exhibiting compressibility of air within the chamber, for at least acoustic frequencies less than about 50 Hz, that is larger than adiabatic compressibility of air; and (h) the larger compressibility exhibited by the occupied fraction of the chamber volume results in the acoustic absorption coefficient of the apparatus exceeding by at least 50%, for at least acoustic frequencies less than about 50 Hz, an acoustic absorption coefficient of an identical chamber having an entire interior volume thereof characterized by the adiabatic compressibility of air.

Example 6

An apparatus for absorbing acoustic energy, the apparatus comprising (i) one or more chamber walls that form an enclosed chamber and (ii) fibrous filler material, wherein: (a) the one or more chamber walls define an interior volume characterized by a chamber volume and a wall area; (b) a first, non-zero fraction of the wall area permits resistive airflow therethrough, and the chamber volume communicates with ambient air only through the resistive fraction of the wall area; (c) at least a fraction of the chamber volume is occupied by the fibrous filler material; (d) density of the fibrous filler material is sufficiently small so as to exhibit only negligible resistance to airflow and only negligible absorption of acoustic energy; (e) density and heat capacity of the fibrous filler material results in the occupied fraction of the chamber volume exhibiting compressibility of air within the chamber, for at least acoustic frequencies up to about 50 Hz, that is larger than adiabatic compressibility of air; and (f) the larger compressibility exhibited by the occupied fraction of the chamber volume results in an acoustic absorption coefficient of the apparatus that exceeds by at least 50%, for at least acoustic frequencies up to about 50 Hz, an acoustic absorption coefficient of an identical chamber having an entire interior volume thereof characterized by the adiabatic compressibility of air.

Example 7

The apparatus of any one of Examples 5 or 6 wherein: (i) density and heat capacity of the fibrous filler material results in the occupied fraction of the chamber volume exhibiting compressibility of air within the chamber, for at least acoustic frequencies up to about 100 Hz, that is larger than adiabatic compressibility of air; and (ii) the larger compressibility exhibited by the occupied fraction of the chamber volume results in the acoustic absorption coefficient of the apparatus exceeding by at least 20%, for at least acoustic frequencies up to about 100 Hz, an acoustic absorption coefficient of an identical chamber having an entire interior volume thereof characterized by the adiabatic compressibility of air.

Example 8

The apparatus of any one of Examples 5 through 7 wherein: (i) density and heat capacity of the fibrous filler material results in the occupied fraction of the chamber volume exhibiting compressibility of air within the chamber, for at least acoustic frequencies up to about 250 Hz, that is larger than adiabatic compressibility of air; and (ii) the larger compressibility exhibited by the occupied fraction of the chamber volume results in the acoustic absorption coefficient of the apparatus exceeding by at least 10%, for at least acoustic frequencies up to about 250 Hz, an acoustic absorption coefficient of an identical chamber having an entire interior volume thereof characterized by the adiabatic compressibility of air.

Example 9

The apparatus of any one of Examples 5 through 8 wherein density and heat capacity of the fibrous filler material results in the occupied fraction of the chamber volume exhibiting compressibility of air within the chamber, for at least acoustic frequencies less than about 50 Hz, about equal to isothermal compressibility of air.

Example 10

The apparatus of any one of Examples 5 through 9 wherein the apparatus is structurally arranged so as to enable adjustment of the occupied fraction of the chamber volume, and adjustment of the occupied fraction results in a corresponding alteration, over at least a portion of acoustic frequencies less than about 250 Hz, of acoustic absorption by the apparatus of acoustic energy incident thereon.

Example 11

The apparatus of any one of Examples 5 through 10 wherein the chamber volume is substantially entirely filled with the fibrous filler material.

Example 12

The apparatus of any one of Examples 5 through 10 wherein the chamber volume is only partly filled with the fibrous filler material.

Example 13

The apparatus of any one of Examples 5 through 12 wherein a mean distance between individual fibers of the fibrous filler material is between about 20 μm and about 500 μm.

Example 14

The apparatus of any one of Examples 5 through 12 wherein a mean distance between individual fibers of the fibrous filler material is between about 50 μm and about 250 μm.

Example 15

The apparatus of any one of Examples 5 through 14 wherein the fibrous filler material is characterized by a mean fiber diameter between about 1 μm and about 50 μm.

Example 16

The apparatus of any one of Examples 5 through 14 wherein the fibrous filler material is characterized by a mean fiber diameter between about 3 μm and about 25 μm.

Example 17

The apparatus of any one of Examples 5 through 16 wherein the fibrous filler material comprises glass fibers at a density between about 0.2 $lb/ft^3$ and about 0.8 $lb/ft^3$.

Example 18

The apparatus of any one of Examples 5 through 16 wherein the fibrous filler material comprises glass fibers at a density between about 0.4 $lb/ft^3$ and about 0.6 $lb/ft^3$.

Example 19

The apparatus of any one of Examples 5 through 18 wherein the fibrous filler material is contained within a fluid-tight flexible bag along with a fluid exhibiting a gas-liquid phase transition in response to air pressure outside the bag.

Example 20

The apparatus of any one of Examples 5 through 19 wherein the fibrous filler material includes granular activated charcoal.

Example 21

The apparatus of any one of Examples 1 through 20 wherein the resistive portion of the wall area comprises glass fibers at a density between about 2 $lb/ft^3$ and about 10 $lb/ft^3$.

Example 22

The apparatus of any one of Examples 1 through 20 wherein the resistive portion of the wall area comprises glass fibers at a density between about 4 $lb/ft^3$ and about 6 $lb/ft^3$.

Example 23

The apparatus of any one of Examples 1 through 22 wherein a second, non-zero fraction of the wall area substantially obstructs airflow therethrough.

Example 24

The apparatus of Example 23 wherein the one or more chamber walls include at least a portion that comprises a substantially rigid shell having multiple perforations therethrough, the multiple perforations form at least a portion of the resistive fraction of the wall area, and the multiple perforations are sized and arranged so as to preferentially reflect or scatter acoustic frequencies above a selected acoustic crossover frequency and preferentially transmit acoustic frequencies below the selected acoustic crossover frequency.

Example 25

The apparatus of Example 24 wherein the selected acoustic crossover frequency is between about 300 Hz and about 500 Hz.

Example 26

The apparatus of any one of Examples 23 through 25 wherein the chamber walls are arranged to form one or more passages protruding into or through the chamber volume, ambient air fills the one or more passages, the resistive fraction of the wall area is arranged entirely within the one or more passages, the obstructive fraction of the wall area includes all wall portions outside the one or more passages, and the obstructive fraction includes remaining wall portions within the one or more passages that are not occupied by the resistive fraction.

Example 27

The apparatus of Example 26 wherein a cross-sectional area of the passage is between about 1 $in^2$ and about 5 $in^2$.

Example 28

The apparatus of Example 26 wherein a cross-sectional area of the passage is between about 2 $in^2$ and about 4 $in^2$.

Example 29

The apparatus of any one of Examples 23 through 25 wherein the chamber walls are arranged to form a cylinder, the resistive fraction of the wall area is arranged as one or more circumferential rings around the cylinder, and the obstructive fraction of the wall area includes both ends of the cylinder and a remaining portion of a lateral surface of the cylinder not occupied by the resistive fraction.

Example 30

The apparatus of any one of Examples 23 through 25 wherein the chamber walls are arranged to form a cylinder, the resistive fraction of the wall area is arranged as one or more longitudinal stripes along the cylinder, and the obstructive fraction of the wall area includes both ends of the cylinder and a remaining portion of a lateral surface of the cylinder not occupied by the resistive fraction.

Example 31

The apparatus of any one of Examples 1 through 30 wherein the one or more chamber walls include one or more telescoping portions arranged so as to enable adjustment of the chamber volume.

Example 32

The apparatus of any one of Examples 1 through 31 wherein the one or more chamber walls include one or more telescoping portions arranged so as to enable adjustment of the area of the resistive fraction of the wall area.

Example 33

The apparatus of any one of Examples 1 through 32 wherein the one or more chamber walls include one or more telescoping portions arranged so as to enable coupled, simultaneous adjustment of the chamber volume and the area of the resistive fraction of the wall area.

Example 34

The apparatus of any one of Examples 1 through 33 wherein the one or more chamber walls include one or more telescoping portions arranged so as to enable independent adjustment of the chamber volume and the area of the resistive fraction of the wall area.

Example 35

The apparatus of any one of Examples 1 through 34 wherein the area of the resistive fraction of the wall area is sufficiently small so that the apparatus exhibits a cut-off frequency less than about 30 Hz.

Example 36

The apparatus of any one of Examples 1 through 34 wherein the area of the resistive fraction of the wall area is sufficiently small so that the apparatus exhibits a cut-off frequency less than about 20 Hz.

Example 37

The apparatus of any one of Examples 1 through 36 further comprising one or more internal bulkheads positioned within the chamber volume.

Example 38

The apparatus of Example 37 wherein at least one of the one or more bulkheads substantially obstructs airflow therethrough, thereby dividing the chamber volume into two of more subvolumes.

Example 39

The apparatus of any one of Examples 37 or 38 wherein at least one or the one or more bulkheads permits airflow therethrough.

Example 40

The apparatus of any one of Examples 1 through 39 wherein the one or more chamber walls are arranged so that a portion of the chamber volume acts as a Helmholtz resonator.

Example 41

The apparatus of Example 40 further comprising an adjustable aperture between the Helmholtz resonator and a remaining portion of the chamber volume.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure or the appended claims, including those sets that may not be explicitly disclosed herein. In addition, for purposes of disclosure, each of the appended dependent claims shall be construed as if written in multiple dependent form and dependent upon all preceding claims with which it is not inconsistent. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof, unless explicitly stated otherwise. For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

For purposes of the present disclosure and appended claims, any labelling of elements, steps, limitations, or other portions of an embodiment, example, or claim (e.g., first, second, etc., (a), (b), (c), etc., or (i), (ii), (iii), etc.) is only for purposes of clarity, and shall not be construed as implying any sort of ordering or precedence of the portions so labelled. If any such ordering or precedence is intended, it will be explicitly recited in the embodiment, example, or claim or, in some instances, it will be implicit or inherent based on the specific content of the embodiment, example, or claim. In the appended claims, if the provisions of 35 USC § 112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. An apparatus for absorbing acoustic energy, the apparatus comprising (i) one or more chamber walls that form an enclosed chamber and (ii) fibrous filler material, wherein:

(a) the one or more chamber walls define an interior volume characterized by a chamber volume and a wall area;

(b) a first, non-zero fraction of the wall area permits resistive airflow therethrough, and the chamber volume communicates with ambient air only through the resistive fraction of the wall area;

(c) at least a fraction of the chamber volume is occupied by the fibrous filler material;

(d) density of the fibrous filler material is sufficiently small so as to exhibit only negligible resistance to airflow and only negligible absorption of acoustic energy;

(e) density and heat capacity of the fibrous filler material results in the occupied fraction of the chamber volume exhibiting compressibility of air within the chamber, for at least acoustic frequencies up to about 50 Hz, that is larger than adiabatic compressibility of air; and (f) the larger compressibility exhibited by the occupied fraction of the chamber volume results in an acoustic absorption coefficient of the apparatus that exceeds by at least 50%, for at least acoustic frequencies up to about 50 Hz, an acoustic absorption coefficient of an identical chamber having an entire interior volume thereof characterized by the adiabatic compressibility of air.

2. The apparatus of claim 1 wherein:

(i) density and heat capacity of the fibrous filler material results in the occupied fraction of the chamber volume exhibiting compressibility of air within the chamber, for at least acoustic frequencies up to about 100 Hz, that is larger than adiabatic compressibility of air; and (ii) the larger compressibility exhibited by the occupied fraction of the chamber volume results in the acoustic absorption coefficient of the apparatus exceeding by at least 20%, for at least acoustic frequencies up to about 100 Hz, an acoustic absorption coefficient of an identical chamber having an entire interior volume thereof characterized by the adiabatic compressibility of air.

3. The apparatus of claim 1 wherein density and heat capacity of the fibrous filler material results in the occupied fraction of the chamber volume exhibiting compressibility of air within the chamber, for at least acoustic frequencies less than about 50 Hz, about equal to isothermal compressibility of air.

4. The apparatus of claim 1 wherein the apparatus is structurally arranged so as to enable adjustment of the occupied fraction of the chamber volume, and adjustment of the occupied fraction results in a corresponding alteration, over at least a portion of acoustic frequencies less than about 250 Hz, of acoustic absorption by the apparatus of acoustic energy incident thereon.

5. The apparatus of claim 1 wherein the chamber volume is substantially entirely filled with the fibrous filler material.

6. The apparatus of claim 1 wherein the fibrous filler material is characterized by a mean fiber diameter between about 1 μm and about 50 μm, and a mean distance between individual fibers of the fibrous filler material is between about 20 μm and about 500 μm.

7. The apparatus of claim 1 wherein the fibrous filler material comprises glass fibers at a density between about 0.2 $lb/ft^3$ and about 0.8 $lb/ft^3$, and the resistive portion of the wall area comprises glass fibers at a density between about 2 $lb/ft^3$ and about 10 $lb/ft^3$.

8. The apparatus of claim 1 wherein the fibrous filler material comprises glass fibers at a density between about 0.4 $lb/ft^3$ and about 0.6 $lb/ft^3$, the resistive portion of the wall area comprises glass fibers at a density between about 4 $lb/ft^3$ and about 6 $lb/ft^3$.

9. The apparatus of claim 1 wherein the fibrous filler material is contained within a fluid-tight flexible bag along with a fluid exhibiting a gas-liquid phase transition in response to air pressure outside the bag.

10. The apparatus of claim 1 wherein the fibrous filler material includes granular activated charcoal.

11. An apparatus for absorbing acoustic energy, the apparatus comprising (i) one or more chamber walls that form an enclosed chamber and (ii) fibrous filler material, wherein:

(a) the one or more chamber walls define an interior volume characterized by a chamber volume and a wall area;

(b) a first, non-zero fraction of the wall area permits resistive airflow therethrough, a second, non-zero fraction of the wall area substantially obstructs airflow therethrough, and the chamber volume communicates with ambient air only through the resistive fraction of the wall area;

(c) one or more of the one or more chamber walls are structurally arranged so as to enable adjustment of one or both of (i) the chamber volume over a selected range of chamber volumes or (ii) area of the resistive fraction of the wall area over a selected range of resistive areas;

(d) adjustment of one or both of the chamber volume or the resistive area results in a corresponding alteration, for at least acoustic frequencies less than about 250 Hz, of an acoustic absorption spectrum of the apparatus;

(e) at least a fraction of the chamber volume is occupied by the fibrous filler material;

(f) density of the fibrous filler material is sufficiently small so as to exhibit only negligible resistance to airflow and only negligible absorption of acoustic energy;

(g) density and heat capacity of the fibrous filler material results in the occupied fraction of the chamber volume exhibiting compressibility of air within the chamber, for at least acoustic frequencies less than about 50 Hz, that is larger than adiabatic compressibility of air; and (h) the larger compressibility exhibited by the occupied fraction of the chamber volume results in the acoustic absorption coefficient of the apparatus exceeding by at least 50%, for at least acoustic frequencies less than about 50 Hz, an acoustic absorption coefficient of an identical chamber having an entire interior volume thereof characterized by the adiabatic compressibility of air.

12. The apparatus of claim 11 wherein the fibrous filler material comprises glass fibers at a density between about 0.2 $lb/ft^3$ and about 0.8 $lb/ft^3$, and the resistive portion of the wall area comprises glass fibers at a density between about 2 $lb/ft^3$ and about 10 $lb/ft^3$.

13. The apparatus of claim 11 wherein the fibrous filler material comprises glass fibers at a density between about 0.4 $lb/ft^3$ and about 0.6 $lb/ft^3$, the resistive portion of the wall area comprises glass fibers at a density between about 4 $lb/ft^3$ and about 6 $lb/ft^3$.

14. The apparatus of claim 11 wherein the one or more chamber walls include one or more telescoping portions arranged so as to enable adjustment of the chamber volume or adjustment of the area of the resistive fraction of the wall area.

15. The apparatus of claim 11 wherein the one or more chamber walls include one or more telescoping portions arranged so as to enable coupled, simultaneous adjustment of the chamber volume and the area of the resistive fraction of the wall area.

16. The apparatus of claim 11 wherein the one or more chamber walls include one or more telescoping portions arranged so as to enable independent adjustment of the chamber volume and the area of the resistive fraction of the wall area.

17. An apparatus for absorbing acoustic energy, the apparatus comprising (i) one or more chamber walls that form an enclosed chamber and (ii) fibrous filler material, wherein:

(a) the one or more chamber walls define an interior volume characterized by a chamber volume and a wall area;

(b) a first, non-zero fraction of the wall area permits resistive airflow therethrough, and the chamber volume communicates with ambient air only through the resistive fraction of the wall area;

(c) a second, non-zero fraction of the wall area substantially obstructs airflow therethrough;

(d) the chamber walls are arranged to form a cylinder, the resistive fraction of the wall area is arranged as one or more circumferential rings around the cylinder or as one or more longitudinal stripes along the cylinder, and the obstructive fraction of the wall area includes both ends of the cylinder and a remaining portion of a lateral surface of the cylinder not occupied by the resistive fraction;

(e) at least a fraction of the chamber volume is occupied by the fibrous filler material;

(f) density of the fibrous filler material is sufficiently small so as to exhibit only negligible resistance to airflow and only negligible absorption of acoustic energy;

(g) density and heat capacity of the fibrous filler material results in the occupied fraction of the chamber volume exhibiting compressibility of air within the chamber, for at least acoustic frequencies less than about 50 Hz, that is larger than adiabatic compressibility of air; and (h) the larger compressibility exhibited by the occupied fraction of the chamber volume results in the acoustic absorption coefficient of the apparatus exceeding by at least 50%, for at least acoustic frequencies less than about 50 Hz, an acoustic absorption coefficient of an identical chamber having an entire interior volume thereof characterized by the adiabatic compressibility of air.

18. The apparatus of claim 17 wherein the fibrous filler material comprises glass fibers at a density between about 0.2 $lb/ft^3$ and about 0.8 $lb/ft^3$, and the resistive portion of the wall area comprises glass fibers at a density between about 2 $lb/ft^3$ and about 10 $lb/ft^3$.

19. The apparatus of claim 17 wherein the fibrous filler material comprises glass fibers at a density between about 0.4 $lb/ft^3$ and about 0.6 $lb/ft^3$, the resistive portion of the wall area comprises glass fibers at a density between about 4 $lb/ft^3$ and about 6 $lb/ft^3$.

20. The apparatus of claim 17 wherein the resistive fraction of the wall area is sufficiently small so that the apparatus exhibits a cut-off frequency less than about 30 Hz.

* * * * *